US008992288B2

(12) United States Patent
Suzuki et al.

(10) Patent No.: US 8,992,288 B2
(45) Date of Patent: Mar. 31, 2015

(54) POLISHING PAD AUXILIARY PLATE AND POLISHING DEVICE EQUIPPED WITH POLISHING PAD AUXILIARY PLATE

(75) Inventors: Tatsutoshi Suzuki, Yokkaichi (JP); Eisuke Suzuki, Yokkaichi (JP)

(73) Assignee: Toho Engineering Kabushiki Kaisha, Yokkaichi-shi mie (JP)

( * ) Notice: Subject to any disclaimer, the term of this patent is extended or adjusted under 35 U.S.C. 154(b) by 594 days.

(21) Appl. No.: 13/339,774

(22) Filed: Dec. 29, 2011

(65) Prior Publication Data

US 2013/0029566 A1 Jan. 31, 2013

(30) Foreign Application Priority Data

Jul. 28, 2011 (JP) ..... 2011-165360

(51) Int. Cl.
*B24B 37/00* (2012.01)
*B24B 37/22* (2012.01)

(52) U.S. Cl.
CPC ..... *B24B 37/22* (2013.01)
USPC ..... 451/285; 451/290

(58) Field of Classification Search
CPC ..... B24B 37/11; B24B 37/12; B24B 37/20; B24B 37/22
USPC ..... 451/41, 285–290
See application file for complete search history.

(56) References Cited

U.S. PATENT DOCUMENTS 5,584,750 A * 12/1996 Ishida et al. ..... 451/288
6,086,464 A * 7/2000 Ulfig et al. ..... 451/259
6,244,941 B1 * 6/2001 Bowman et al. ..... 451/287
6,398,905 B1 * 6/2002 Ward ..... 156/345.12
6,835,118 B2 * 12/2004 Berkstresser et al. ..... 451/28
7,118,465 B2 * 10/2006 Kim ..... 451/290
7,156,722 B2 * 1/2007 Min et al. ..... 451/41
7,727,052 B2 * 6/2010 Borucki ..... 451/41
8,449,351 B2 * 5/2013 Moon et al. ..... 451/41
8,702,477 B2 * 4/2014 Suzuki et al. ..... 451/259
2003/0114079 A1 * 6/2003 Berkstresser et al. ..... 451/28

FOREIGN PATENT DOCUMENTS

JP A-2002-11630 1/2002
JP A-2010-141155 6/2010
JP A-2010-214579 9/2010

* cited by examiner

*Primary Examiner* — Maurina Rachuba
(74) *Attorney, Agent, or Firm* — Oliff PLC

(57) ABSTRACT

A polishing pad auxiliary plate including: a lower auxiliary plate overlapping a top surface of a rotating surface plate of a polishing device; a first adhering member adhering the lower auxiliary plate to the rotating surface plate; an upper auxiliary plate with a pad support surface on which the polishing pad is overlapped and adhered, while overlapping a top surface of the lower auxiliary plate; a second adhering member adhering the upper auxiliary plate to the lower auxiliary plate; and an alignment member for mutually aligning the lower and upper auxiliary plates and matching center axes thereof. By removing the upper auxiliary plate from the lower auxiliary plate, the polishing pad is removed from the rotating surface plate while being adhered to the pad support surface of the upper auxiliary plate, and the removed upper auxiliary plate is reattached and aligned to the lower auxiliary plate by the alignment member.

6 Claims, 11 Drawing Sheets

POLISHING PAD AUXILIARY PLATE AND POLISHING DEVICE EQUIPPED WITH POLISHING PAD AUXILIARY PLATE

INCORPORATED BY REFERENCE

The disclosure of Japanese Patent Application No. 2011-165360 filed on Jul. 28, 2011 including the specification, drawings and abstract is incorporated herein by reference in its entirety.

BACKGROUND OF THE INVENTION

1. Field of the Invention

The present invention relates to technology related to polishing of substrates, which are objects to be processed, requiring a high flatness processing precision such as for silicon wafers or semiconductor substrates, glass substrates or the like, and particularly relates to technology for which it is possible to realize reuse of polishing pads used when polishing the surface of these substrates.

2. Description of the Related Art

As is well known, when manufacturing semiconductors, a polishing process that flattens the surface of a substrate such as a silicon wafer, semiconductor substrate, glass substrate or the like, which are structural components, is performed. This polishing process is typically implemented by directly fixing a disk shaped polishing pad consisting of resin material or the like using double sided tape on a rotating surface plate of a polishing device, and while supplying polishing liquid containing abrasive grains, doing rotary motion of the polishing pad and the substrate relative to each other to perform polishing.

Then, as a polishing pad for implementing this kind of polishing process, as is noted in Published Unexamined Patent Application No. JP-A-2002-11630 and the like, a resin pad consisting of foaming or non-foaming urethane or the like is used. Also, in many cases, on the polishing surface of this polishing pad, a grooving process is implemented such as in concentric circle form, grid form, radial form or the like, or bubbles of the foaming resin are opened or the like.

In the polishing processing using a polishing pad, the polishing pad sometimes has to be torn off the rotating surface plate and changed to a different polishing pad, upon switching the kind of substrate which is the object to be polished or the like. Also, even in cases such as when reprocessing by surface grooving or the like using a different processing device for the purpose of reuse or the like of polishing pads which have degraded along with the polishing process, for example, it is necessary to tear off the polishing pad from the rotating surface plate.

However, thin disk shaped polishing pads are adhered strongly by adhesive tape to the rotating surface plate of the polishing device, so when tearing off this polishing pad from the rotating surface plate, damage such a bending or warping, wrinkles, breakage or the like occurs easily to the polishing pad. Accordingly, due to this kind of damage, there is the problem that this polishing pad, despite the fact that its product life has not ended, often must be discarded because it cannot be reused.

There is also the problem that the work of tearing off the polishing pad from the rotating surface plate while paying close attention not to cause damage is a great burden on the worker as it requires skill and caution. In addition, there was also the problem that because considerable time is required for the work of tearing the polishing pad off the rotating surface plate, the expensive and valuable polishing device has to be stopped for a long time, limiting the operating time of the device.

In light of this, with Published Unexamined Patent Application No. JP-A-2010-214579, the inventors previously proposed a polishing pad with auxiliary plate made so that an auxiliary plate is attached to the back surface of the polishing pad, and via this auxiliary plate, the polishing pad is adhered by double sided tape to the rotating surface plate of a polishing device. With this polishing pad with auxiliary plate, since the polishing pad is attached and detached in relation to the rotating surface plate while maintaining the state of the polishing pad being supported as is by the auxiliary plate, the auxiliary plate reinforces against damage of the polishing pad when attaching and detaching. This makes it possible to attach and detach the polishing pad in relation to the rotating surface plate with good workability while preventing damage to the polishing pad.

However, after a great deal of further research and study by the inventors, with the polishing pad with auxiliary plate proposed with JP-A-2010-214579, they found it hard to say that it is always easy to be compatible with all polishing devices.

Specifically, when overlapping the polishing pad on the rotating surface plate and adhering it, it is necessary to align the center of the polishing pad with the rotation center of the rotating surface plate, and particularly with polishing pads for which grooves or the like have been implemented on the polishing surface, precision is needed for aligning the centers. Also, when there is an increase in the number of attachments and detachments of the polishing pad to the rotating surface plate with use of an auxiliary plate as described above, the work of aligning the centers when attaching the polishing pad to the rotating surface plate becomes even more difficult, and there is a big problem in that the labor burden becomes high.

Also, with the polishing pad with auxiliary plate proposed in JP-A-2010-214579, in order to be attachable and detachable while aligning the center of the auxiliary plate to the rotating surface plate, there are cases when an adhering means such as an outer circumference ring or the like is provided on the outer circumference surface of the rotating surface plate, for example, between the auxiliary plate and the rotating surface plate. Meanwhile, within the polishing device, a protective cover or the like is mounted on the outer circumference side of the rotating surface plate, and there are some items for which of the rotating surface plate outer circumference side space is very narrow. Therefore, if an attempt is made to use that kind of outer circumference ring using a polishing device for which the outer circumference side space of the rotating surface plate happens to be narrow, there is the risk that it will be necessary to modify the polishing device or the like.

SUMMARY OF THE INVENTION

It is therefore one object of this invention to provide a polishing pad auxiliary plate of novel construction, which makes it possible to easily perform detaching and attaching of a polishing pad to a rotating surface plate while sufficiently ensuring the adhesive force of the polishing pad to the rotating surface plate, and particularly to be able to prevent damage to the polishing pad when tearing off the polishing pad from the rotating surface plate, and to be advantageous for realizing reuse of the polishing pad, for example.

An additional object of the present invention is to provide a polishing pad auxiliary plate of an improved constitution for which it is possible to easily and with good precision perform the work of aligning the centers when mounting the polishing pad on the rotating surface plate, lightening the labor burden, and also to be able to easily and advantageously apply this to rotating surface plates of conventional polishing devices of various specifications without having to do special modifications.

A further object of the present invention is to provide a polishing device equipped with a polishing pad auxiliary plate having this novel constitution.

First aspect of the present invention relates to a polishing pad auxiliary plate. A first mode of the first aspect of the present invention provides (A) A polishing pad auxiliary plate adapted to be mounted on a rotating surface plate of a polishing device for detachably attaching a polishing pad on the rotating surface plate, comprising: (B) a lower auxiliary plate adapted for overlapping a top surface of the rotating surface plate; (C) a first adhering member for adhering the lower auxiliary plate to the rotating surface plate; (D) an upper auxiliary plate equipped with a pad support surface on which the polishing pad is overlapped and adhered, and adapted for overlapping a top surface of the lower auxiliary plate; (E) a second adhering member for adhering the upper auxiliary plate to the lower auxiliary plate; and (F) an alignment member for mutually aligning the lower auxiliary plate and the upper auxiliary plate and matching center axes thereof, wherein by removing the upper auxiliary plate from the lower auxiliary plate adhered to the rotating surface plate by means of the first adhering member, the polishing pad is removable from the rotating surface plate in a state still adhered to the pad support surface of the upper auxiliary plate, and the removed upper auxiliary plate is re-adhereable and attachable in an aligned state to the lower auxiliary plate by means of the alignment member.

With the polishing pad auxiliary plate constituted according to the present invention, the polishing pad is mounted adhered to the rotating surface plate via the upper auxiliary plate and the lower auxiliary plate. This arrangement makes is possible to remove the upper auxiliary plate from the lower auxiliary plate with the lower auxiliary plate left adhered to the rotating surface plate, allowing to remove the polishing pad from the rotating surface plate with it left in a state adhered to the upper auxiliary plate.

Because of that, it is possible to remove the polishing pad from the rotating surface plate while preventing damage to the polishing pad with the polishing pad in a state reinforced and protected by the upper auxiliary plate, making handling of thin polishing pads easy. Then, for example upon repeating attachment and detachment of a polishing pad when changing the item subject to polishing, the polishing conditions or the like, or when removing a worn polishing pad and remounting it after regeneration processing or the like, it is also possible to easily perform the work of attaching and detaching the polishing pad on the rotating surface plate, the regenerating processing of the polishing pad, and the like.

Moreover, since the lower auxiliary plate which is left adhered to the rotating surface place and the upper auxiliary plate removed together with the polishing pad have their center axes matched by the alignment member, making it possible to more easily perform the work of attaching and detaching the polishing pad to the rotating surface plate, which requires alignment. In particular, this alignment member is provided between the lower auxiliary plate and the upper auxiliary plate, so it is not necessary to implement special processing or the like on the rotating surface plate. Also, this alignment member is able to avoid a large projection further to the outer circumference side than the rotating surface plate, and can be applied without having to implement a special modification of polishing devices for which a protective cover or the like is provided on the outer circumference side of the rotating surface plate, for example.

A second mode of the first aspect of the present invention provides the polishing pad auxiliary plate according to the first mode, wherein an adhesive force of the lower auxiliary plate and the upper auxiliary plate by the second adhering member is smaller than an adhesive force of the rotating surface plate and the lower auxiliary plate by the first adhering member.

With the second invention according to this mode, by mutually adjusting and setting the adhesive force of the first and second adhering members, the work of removing the upper auxiliary plate with the polishing pad left adhered from the lower auxiliary plate left adhered to the rotating surface plate becomes easier. In other words, it is possible to easily remove the polishing pad from the rotating surface plate in a state left adhered to the upper auxiliary plate while the lower auxiliary plate remains in a state adhered to the rotating surface plate, without requiring a special operation or the like to keep the lower auxiliary plate in an adhered state on the rotating surface plate.

A third mode of the first aspect of the present invention provides the polishing pad auxiliary plate according to the first or second mode, wherein the alignment member is provided at a position further to an inner circumference side than an outer circumference surface of the lower auxiliary plate and the upper auxiliary plate.

With the polishing pad auxiliary plate of this mode, projection of the alignment member to the outer circumference side of the upper and lower auxiliary plates is completely avoided. As a result, even for example when setting the outer diameter dimension of the upper and lower auxiliary plates to be the same or slightly smaller than the outer diameter dimension of the rotating surface plate for mounting, it is possible to secure a sufficiently large support surface of the polishing pad and to avoid projection of the alignment member to the outer circumference side from the rotating surface plate. Therefore, even if a protective cover or the like is installed on the outer circumference side of the rotating surface plate, it is possible to avoid this becoming a problem when applying the polishing pad auxiliary plate of the present invention.

A fourth mode of the first aspect of the present invention provides the polishing pad auxiliary plate according to the third mode, wherein the alignment member comprises at least one engaging convex part provided on one of the lower auxiliary plate and the upper auxiliary plate and projecting facing the other, and at least one engaging concave part provided on the other of the lower auxiliary plate and the upper auxiliary plate and engaging with the engaging convex part.

The polishing pad auxiliary plate of this mode makes it possible to easily obtain a large aligning force mechanically based on the mutual engagement action of the engaging convex part and the engaging concave part. Also, by adjusting the shape, size, number of or the like of the engaging convex part and the engaging concave part, it is also possible to set the alignment action direction and acting force easily with a large degree of freedom.

A fifth mode of the first aspect of the present invention provides the polishing pad auxiliary plate according to the fourth mode, wherein the engaging convex part and the engaging concave part are formed with engagement portions positioned at an outer circumference part of the lower auxiliary plate and the upper auxiliary plate.

In the polishing pad auxiliary plate of this mode, the concave and convex parts fit to each other, i.e., the engaging outer circumference surface of the engaging convex part and the engaging inner circumference surface of the engaging concave part are formed and positioned at the outer circumference part separated from the center of the polishing pad auxiliary plate. This makes it possible to improve the relative alignment precision of the upper and lower auxiliary plates, particularly the radial direction alignment precision. Note that as shown with the sixth and seventh modes described later as well, it is possible to have a mode for which the engaging outer circumference surface of the engaging convex part and the engaging inner circumference surface of the engaging concave part extend in the circumference direction along the outer circumference edge part of the polishing pad auxiliary plate around the center of the polishing pad auxiliary plate, and also possible to have a mode for which they are partially positioned on the circumference such as with the engaging convex part and the engaging concave part formed on the outer circumference part of the polishing pad auxiliary plate.

A sixth mode of the first aspect of the present invention provides the polishing pad auxiliary plate according to the fifth mode, wherein the engagement portions of the engaging convex part and the engaging concave part are constituted by a ring shaped engaging outer circumference surface and engaging inner circumference surface which are fit to each other extending continuously in a circumference direction of the lower auxiliary plate and the upper auxiliary plate.

In the polishing pad auxiliary plate of this mode, more preferably, the engaging concave part and the engaging convex part are formed having ring shaped engaging inner and outer circumference surfaces which broaden around the center axis of the polishing pad auxiliary plate. With this arrangement, it is no longer necessary to mutually align in the circumference direction when mounting the upper auxiliary plate on the lower auxiliary plate, so work can be done easily and quickly.

A seventh mode of the first aspect of the present invention provides the polishing pad auxiliary plate of the fifth mode, wherein the at least one engaging convex part comprises a plurality of engaging convex parts, and the at least one engaging concave part comprises a plurality of engaging concave parts, and wherein at a plurality of locations on a circumference at the outer circumference part of the lower auxiliary plate and the upper auxiliary plate, formed at mutually corresponding positions are the plurality of engaging concave parts at one of mutually overlapping surfaces of the lower auxiliary plate and the upper auxiliary plate which open facing an other, and the plurality of engaging convex parts at the other of the mutually overlapping surfaces of the lower auxiliary plate and the upper auxiliary plate which project facing the one, and the engagement portions are constituted by fitting the engaging convex parts into the engaging concave parts.

With the polishing pad auxiliary plate of this mode, it becomes possible to easily realize mutual alignment of the upper and lower auxiliary plates even in the circumference direction around the center axis, not just in the direction perpendicular to the center axis.

An eighth mode of the first aspect of the present invention provides the polishing pad auxiliary plate according to the fifth mode, wherein the at least one engaging convex part comprises a plurality of engaging convex parts, and the at least one engaging concave part comprises a plurality of engaging concave parts, wherein the plurality of engaging convex parts are formed by an elastic material and located at a plurality of locations on a circumference at the outer circumference part of one of the lower auxiliary plate and the upper auxiliary plate so as to project toward an other, and wherein tips of the engaging convex parts are engaged in relation to the plurality of engaging concave parts provided opening at the outer circumference surface of the other of the lower auxiliary plate and the upper auxiliary plate, so as to provide the engagement portions.

With the polishing pad auxiliary plate of this mode, it is possible to form with the engagement portions exposed on the outer circumference surface of the upper and lower auxiliary plates. This arrangement makes it possible to easily confirm the engagement status of the engagement portions by visual observation or the like. Also, this mode makes it possible to stably maintain the engaged state at the engagement portions using the elasticity of the engaging convex part.

A ninth mode of the first aspect of the present invention provides the polishing pad auxiliary plate of the fourth mode, wherein the engaging convex part and the engaging concave part are provided on a center axis of the lower auxiliary plate and the upper auxiliary plate.

With the polishing pad auxiliary plate of this mode, by providing the engaging convex part and the engaging concave part on the center axis of the upper and lower auxiliary plates, it is possible to perform center axis matching of the upper and lower auxiliary plates using one engagement portion. Also, when mutually aligning the engaging convex part and the engaging concave part provided on the center axis, it is possible to easily have an engaged state of these engaging convex part and engaging concave part without requiring mutual alignment in the circumference direction of the upper and lower auxiliary plates.

A tenth mode of the first aspect of the present invention provides the polishing pad auxiliary plate according to the ninth mode, wherein thread grooves that screw together are formed at an outer circumference surface of the engaging convex part and an inner circumference surface of the engaging concave part, and the second adhering member is constituted by the engaging concave part and the engaging convex part that constitute the alignment member being screwed together.

The polishing pad auxiliary plate of this mode makes it possible to obtain adhesive force of the upper auxiliary plate and the lower auxiliary plate using the alignment member. With this arrangement, it is possible to constitute the second adhering member only using this alignment member, and to do auxiliary constitution of the adhesion force between the upper and lower auxiliary plates by the second adhering member with the alignment member.

An eleventh mode of the first aspect of the present invention provides the polishing pad auxiliary plate according to any one of the fourth, fifth, sixth, seventh, ninth or tenth modes, wherein the engaging convex part provided at one of the lower auxiliary plate and the upper auxiliary plate is formed with the same material as the one of the lower auxiliary plate and the upper auxiliary plate.

The polishing pad auxiliary plate of this mode makes it possible to prevent there being a big local difference in the support characteristics of the polishing pad with the auxiliary plates overlapping above and below with the engaging convex part forming part. Because of that, upon pressing force acts on the polishing pad surface when doing pad polishing processing, at the engaging convex part and the engaging concave part forming site for the upper and lower auxiliary plates which support this polishing pad, it is possible to reduce or avoid problems such as with polishing precision or the like due to a local difference in characteristics such as of the pressing reaction force, the polishing pad elasticity, or the like.

Second aspect of the present invention relates to a polishing device. A first mode of the second aspect of the present invention provides a polishing device, wherein the device is equipped with a polishing pad auxiliary plate according to any one of the first through eleventh modes of the first aspect of the present invention, and wherein the polishing pad auxiliary plate is mounted on the top surface of the rotating surface plate, and a protective member is provided arranged across a gap at an outer circumference side of the rotating surface plate, while the alignment member is provided positioned further to an inner circumference side than outer circumference end surfaces of the rotating surface plate and the polishing pad auxiliary plate.

The use of the polishing device according to the second aspect of the present invention while using the polishing pad auxiliary plate according to the first aspect of the present invention makes it possible to easily remove and mount the polishing pad from and on the rotating surface plate while preventing damage to the polishing pad, and to perform alignment of the polishing pad to the rotating surface plate during mounting easily and with good precision.

BRIEF DESCRIPTION OF THE DRAWINGS

The foregoing and/or other objects features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

Figure 1:
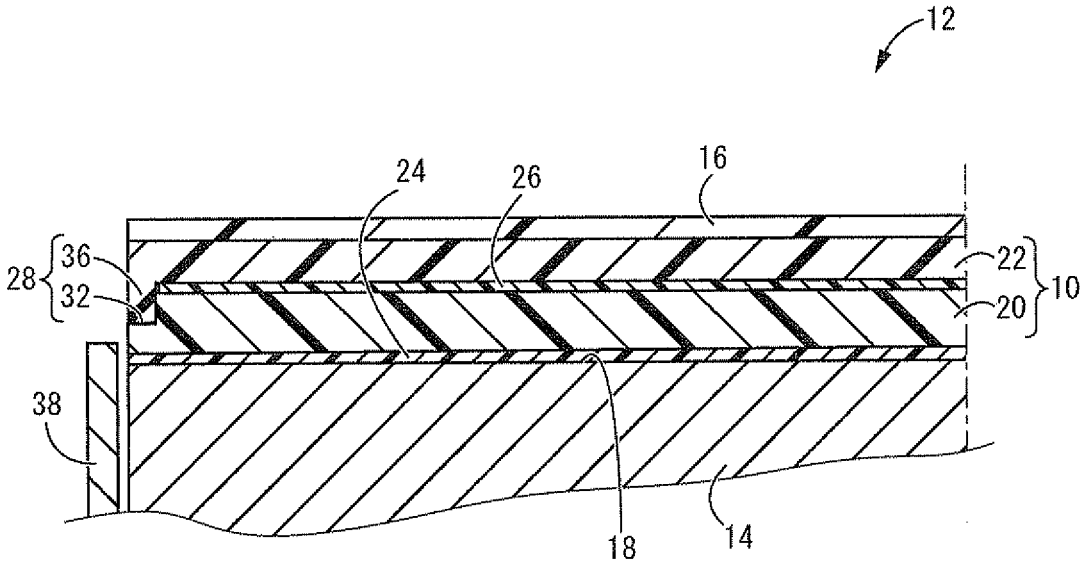
FIG. 1 is a vertical cross section view showing the key parts of a polishing device on which a polishing pad auxiliary plate according to a first embodiment of the present invention is mounted.
Figure 2:
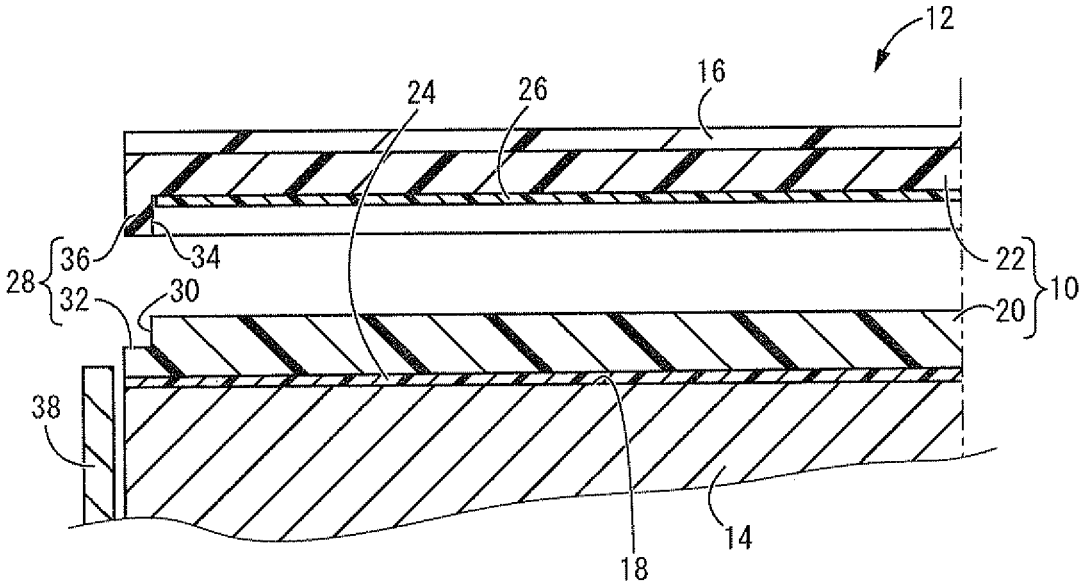
FIG. 2 is a vertical cross section explanatory view showing the state of the polishing pad removed with the polishing device shown in FIG. 1.

First, FIGS. 1 and 2 show a polishing pad auxiliary plate 10 according to a first embodiment of the present invention. This polishing pad auxiliary plate 10 is used mounted on the rotating surface plate 14 of the polishing device 12, and is made so that the polishing pad 16 can be detachably attached to the rotating surface plate 14.

The polishing device is an item used as a CMP device as noted in Published Unexamined Patent Application No. JP-A-2010-141155 or the like, for example, and though the basic structure is well known, to describe the key parts, first, a rotation axis extending in the vertical direction is supported to be able to rotate by a device main unit installed in a fixed manner on a foundation base, and a disk shaped rotating surface plate 14 is provided in a fixed manner on the top end part of this rotation axis. This rotating surface plate 14 has a flat top surface 18 that broadens in the horizontal direction, and this top surface 18 is the support surface of the polishing pad 16. Also, a rotation output axis of an electric motor is linked to the rotation axis, and by the drive force of the electric motor being transmitted, the rotation axis and thus the rotating surface plate 14 are made to be rotationally driven around a center axis. Note that above the top surface 18 that supports the polishing pad 16, a nozzle for supplying polishing slurry is arranged, and also, a polishing head is arranged for implementing polishing processing by pressing on the polishing pad 16 while holding and rotating a wafer or the like which is the polishing subject (object to be polished).

With this kind of polishing device, the polishing pad auxiliary plate 10 mounted on the rotating surface plate 14 includes a lower auxiliary plate 20 and an upper auxiliary plate 22. Then, the lower auxiliary plate 20 is adhered to the top surface 18 of the rotating surface plate 14 using the first adhering member 24, and furthermore, the upper auxiliary plate 22 is adhered to the top surface of the lower auxiliary plate 20 using the second adhering member 26. Specifically, by adhering the lower auxiliary plate 20 and the upper auxiliary plate 22 overlapped with each other via the second adhering member 26, the polishing pad auxiliary plate 10 is constituted overall as a two layer structure, and this is attached to the top surface 18 of the rotating surface plate 14 using the first adhering member 24.

The lower auxiliary plate 20 and the upper auxiliary plate 22 both have a thin, roughly round flat plate shape, and have a flat front surface (top surface) and back surface (bottom surface). These upper and lower auxiliary plates 22 and 20 are preferably items of a material that is harder than the mounted polishing pad 16, and have a member rigidity greater than that of the polishing pad 16. Though it depends on the use method, as described hereafter, while use of the lower auxiliary plate 20 without repeating attachment and detachment after attachment to the rotating surface plate 14 is possible, since it is expected that there will be repeated attachment and detachment after the upper auxiliary plate 22 is attached to the rotating surface plate 14, it is preferable that at least for the upper auxiliary plate 22, an item is used that has a greater member rigidity than that of the polishing pad 16.

The upper auxiliary plate 22 supports the polishing pad 16, and it can be an item that satisfies the strength, rigidity, shape stability, and precision required when doing various types of processing such as dressing, cleaning, re-grooving or the like on the polishing pad surface, in addition to the polishing processing using the polishing device 12. Thus, there is no restriction on the material or thickness dimension of the upper auxiliary plate 22. In particular, not only the lower auxiliary plate 20, but also the upper auxiliary plate 22, does not bear the support strength, rigidity and the like of the polishing pad 16 as a stand alone item. But rather when doing polishing processing for example, the bottom surface of the upper auxiliary plate 22 is supported by the rotating surface plate 14, with being overlapped on the rotating surface plate 14 of the polishing device 12. Thus, the upper auxiliary plate 22 does not need to be much strength or rigidity as a stand alone item. Accordingly, in addition to metals such as stainless steel or the like, synthetic resin or fiber reinforced resin or the like can also be used as the forming material of the lower auxiliary plate 20 or the upper auxiliary plate 22. In particular, synthetic resin has easier processing and handling and is lighter than metal materials, and for example polycarbonate and the like has the advantage of being excellent in terms of stability of the thickness dimension precision and low distortion characteristics in relation to changes in temperature.

Also, in order to obtain a stable support force across the entire polishing pad 16, it is preferable to set the outer diameter dimension of the upper auxiliary plate 22 to a value greater than the outer diameter dimension of the polishing pad 16, it is preferable to set the outer diameter dimension of the lower auxiliary plate 20 to a value greater than the outer diameter dimension of the upper auxiliary plate 22, and also, it is preferable to set the outer diameter dimension of the lower auxiliary plate 20 to a value lower than the outer diameter dimension of the rotating surface plate 14. In particular, as shown in FIGS. 1 and 2, by making the outer diameter dimensions of the lower auxiliary plate 20 and the upper auxiliary plate 22 roughly the same, and also by making the outer diameter dimension of the mounted rotating surface plate 14 roughly the same, it is possible to ensure a sufficiently large support surface for the polishing pad 16. This arrangement makes it possible to mount a polishing pad 16 of roughly the same size as the rotating surface plate 14 on the rotating surface plate 14 having roughly the same support force across the entirety.

Furthermore, as the first adhering member 24 and the second adhering member 26, as long as it is an item that is able to hold the lower auxiliary plate 20 and the upper auxiliary plate 22 in an adhered state on the top surface 18 of the rotating surface plate 14 in resistance to the external force applied when polishing, there are no particular restrictions. In specific terms, a bonding agent or adhesive agent, or double sided tape to which a bonding agent or adhesive agent is attached or the like to both sides of a base material sheet or the like can be used as the first and second adhering members 24 and 26, but in addition, it is also possible to use negative pressure suction using negative pressure air or the like, or magnetic suction using a permanent magnet or electromagnet or the like. Also, an adhering means consisting of these bonding agents or the like preferably applies a roughly even adhesive force across roughly the entire surface of the flat overlapping surface of the lower auxiliary plate 20 and the upper auxiliary plate 22. This arrangement makes it possible to obtain a large adhesive force, and also to avoid problems such as locally differing support characteristics of the polishing pad 16 on the surface of the polishing pad auxiliary plate 10.

For example, with negative pressure suction or an electromagnet, the adhesive force can be turned on and off, but when applying a fixed adhesive force such as with a bonding agent or the like, it is preferable to set the adhesive force of the upper auxiliary plate 22 on the lower auxiliary plate 20 by the second adhering member 26 lower than the adhesive force of the lower auxiliary plate 20 on the rotating surface plate 14 by the first adhering member 24. With this arrangement, when tearing off and removing the upper auxiliary plate 22 from the lower auxiliary plate 20, it is possible to easily realize leaving the lower auxiliary plate 20 left adhered on the rotating surface plate 14. For specific realization of this kind of difference in adhesive force, in addition to making the adhering means such as the material of the bonding agent or adhesive agent or the like mutually different, it is also possible to realize this by making the adhesion area or the adhesion surface state (whether or not there is processing such as surface roughness, plasma or the like) mutually different.

Yet further, the surface (top surface) of the upper auxiliary plate 22 is the polishing pad support surface, and the polishing pad 16 is attached overlapping this. For this polishing pad 16, it is possible to use various types of polishing pads that are well known from the past. Also, the back surface of this polishing pad 16 is adhered to the surface of the upper auxiliary plate 22 using conventionally known adhesive tape, a suitable bonding agent, or the like for sticking on the polishing pad.

Note that it is preferable to set the adhering means of the polishing pad 16 to the upper auxiliary plate 22 to a greater adhesive force than that of the previously described second adhering member 26. With this arrangement, when removing the upper auxiliary plate 22 from the lower auxiliary plate 20 in a state with the polishing pad 16 left adhered, it is possible to effectively prevent unexpected peeling of the polishing pad 16 from the upper auxiliary plate 22 even when the upper auxiliary plate 22 is curved or the like.

Also, the outer diameter dimension of the polishing pad 16 is typically a standard value, but in many cases, it is set to be the same or smaller than the outer diameter dimension of the top surface 18 of the mounted rotating surface plate 14.

Furthermore, it is also possible to provide a suitable cushion layer at least for one of, for example, between the top surface 18 of the rotating surface plate 14 and the lower auxiliary plate 20, between the lower auxiliary plate 20 and the upper auxiliary plate 22, and between the upper auxiliary plate 22 and the polishing pad 16. By providing this kind of cushion layer, it is possible to make the polishing efficiency or the like on the object to be processed uniform across the entire surface when doing polishing processing using the polishing pad 16.

As this cushion layer, it is possible to suitably use for example a resin sheet given a certain degree of compressibility using foaming or the like, elastomer sheets, rubber sheets, or the like. It is also possible to constitute the cushion layer using the first adhering member 24, the second adhering member 26, or the adhering means of the polishing pad 16 on the upper auxiliary plate 22. Note that the cushion layer is preferably formed so as to exist at a fixed thickness with a size across roughly the entirety of the support area of the polishing pad 16 to prevent local distortion of the support surface of the polishing pad 16.

Also, an alignment member 28 for mutually aligning and matching the center axes is provided between the lower auxiliary plate 20 and the upper auxiliary plate 22 constituting the polishing pad auxiliary plate 10. With this embodiment, a circular stepped surface 30 is formed extending across the entire circumference around the center axis of the lower auxiliary plate 20 at the outer circumference part of the lower auxiliary plate 20. Then, the thickness dimension of the lower auxiliary plate 20 is made smaller at the outer circumference side of this stepped surface 30. Thus, a ring shaped engaging concave part 32 continuously extending to the entire circumference of the circumference direction having a notched cross section shape open at the outer circumference surface of the lower auxiliary plate 20 is integrally formed at the lower auxiliary plate 20.

Meanwhile, with this embodiment, a circular stepped surface 34 extending across the entire circumference around the center axis of the upper auxiliary plate 22 is formed on the outer circumference part of the upper auxiliary plate 22. Then, the thickness dimension of the upper auxiliary plate 22 is made greater at the outer circumference side of this stepped surface 34. Thus, a ring shaped engaging convex part 36 continuously extending to the entire circumference of the circumference direction along the outer circumference edge of the upper auxiliary plate 22 is integrally formed at the upper auxiliary plate 22. Note that the engaging convex part 36 and the engaging concave part 32 can also be formed on either of the upper or lower auxiliary plates 22 or 20.

The previously described lower auxiliary plate 20 stepped surface 30 and the engaging concave part 32 are mutually aligned in relation to the upper auxiliary plate 22 stepped surface 34 and the engaging convex part 36, and with this embodiment, constitute the engaging outer circumference surface and the engaging inner circumference surface. Then, when the upper auxiliary plate 22 is overlapped on the lower auxiliary plate 20, the engaging convex part 36 is fit into the engaging concave part 32, the stepped surface 34 is overlapped on the stepped surface 30 in the radial direction, and the engagement portions are formed. Accordingly, the alignment member 28 is constituted by the engaging concave part 32 and the engaging convex part 36, and in a state with the center axes matched to each other and aligned in the radial direction, the upper auxiliary plate 22 is overlapped on the lower auxiliary plate 20. Note that the alignment member 28 is provided positioned further to the inner circumference side than the outer circumference surface of the upper and lower auxiliary plates 22 and 20, and by doing that, the upper and lower auxiliary plates 22 and 20 and thus the polishing device 12 do not become large.

With a polishing device 12 equipped with a polishing pad auxiliary plate 10 constituted in this way, as shown in FIG. 1, the polishing pad auxiliary plate 10 constituted from the upper and lower auxiliary plates 22 and 20 is adhered and mounted on the top surface 18 of the rotating surface plate 14, and also, in a state with the polishing pad 16 adhered and supported on the top surface of the upper auxiliary plate 22, the rotating surface plate 14 is rotationally driven and CMP (chemical mechanical polishing) is implemented on the object to be processed such as a substrate or the like. Then, this polishing device 12 is able to exhibit special technical effects as described below by being equipped with a specially structured polishing pad auxiliary plate 10.

First, as shown in FIG. 2, the upper auxiliary plate 22 is removed from the lower auxiliary plate 20 adhered to the rotating surface plate 14 by means of the first adhering member 24, with the polishing pad 16 left adhered to the top surface of the upper auxiliary plate 22. This makes it possible to remove the polishing pad 16 from the rotating surface plate 14. Then, even when doing cleaning or re-processing or the like of the surface (polishing surface) of the polishing pad 16 removed from the rotating surface plate 14, it is possible to perform that with the polishing pad 16 left adhered to the top surface of the upper auxiliary plate 22. With this arrangement, of course when detaching and attaching the polishing pad 16 in relation to the rotating surface plate 14 or when doing cleaning or re-processing or the like of the polishing pad 16, but also when transporting or storing the polishing pad 16 or the like, it is possible to prevent bending or damage to the polishing pad 16 using the reinforcing action of the upper auxiliary plate 22, and to keep the polishing pad 16 in good condition.

Also, when the polishing pad 16 is removed from the rotating surface plate 14 together with the upper auxiliary plate 22, the lower auxiliary plate 20 is left on the top surface 18 of the rotating surface plate 14. Then, when the polishing pad 16 is again mounted on the rotating surface plate 14, the alignment member 28 provided between the upper auxiliary plate 22 and the lower auxiliary plate 20 makes it possible to easily match the center axes with good precision for the upper auxiliary plate 22, and thus the polishing pad 16 in relation to the lower auxiliary plate 20, and thus the rotating surface plate 14.

Here, the engaging concave part 32 and the engaging convex part 36 constituting this alignment member 28 are in a state fitted to each other so they overlap with almost no gap, so it is possible to prevent an adverse effect on the support characteristics of the polishing pad 16. Also, of the outer circumference part of the upper and lower auxiliary plates 22 and 20, particularly with this embodiment, the engagement portions, said another way the alignment member 28, is formed at the outer circumference edge part, and since the radial direction center part which is the area mainly used for polishing is off the mark with the polishing pad 16, even when there is a slight gap at the fitting part of the engaging concave part 32 and the engaging convex part 36, it is possible to avoid an adverse effect to the support characteristics of the polishing pad 16 to the degree of large problems occurring with the polishing characteristics.

Moreover, the engaging concave part 32 and the engaging convex part 36 constituting the alignment member 28 are formed further to the inner circumference side than the overlapping surface of the upper and lower auxiliary plates 22 and 20, said another way, the outer circumference end surface of the rotating surface plate 14 and the polishing pad auxiliary plate 10, and it is possible to avoid projection to the outer circumference surface of the upper and lower auxiliary plates 22 and 20. Thus, for example as shown in FIGS. 1 and 2, even when a protective member 38 is installed near the outer circumference side of the rotating surface plate 14 with the polishing device 12, it is possible to realize a polishing device 12 equipped with upper and lower auxiliary plates 22 and 20 equipped with alignment member 28 while avoiding interference with that kind of protective member 38.

Moreover, as described above, as a result of being able to attach and detach the polishing pad 16 to the rotating surface plate 14 quickly with accurate aligning precision while preventing damage to the polishing pad 16, there is no longer unnecessary restriction of the operating time of the expensive polishing equipment to do the work of attaching and detaching the polishing pad 16 and the like, and it is possible to achieve an improvement in the operating efficiency of the polishing equipment and thus in the production efficiency (polishing work efficiency) of a substrate or the like.

Also, since attachment and detachment of the polishing pad 16 on the rotating surface plate 14 is easily realized, it is possible to realize reuse of the polishing pad 16 at a practical level even without special skill or knowledge. Specifically, it has become possible to study at a practical utilization level, for example, reuse of a polishing pad 16 removed once from the rotating surface plate 14 when switching product types or the like of the object to be polished such as a substrate or the like, or reuse after re-processing of a polishing pad 16 removed once from the rotating surface plate 14 to do re-processing such as surface grooving or the like using a different processing device as a degradation countermeasure.

We described above a first embodiment of the present invention, but the specific constitution of the present invention should not be interpreted as being limited by this first embodiment. Following are shown by example a plurality of other embodiments of the present invention equipped with alignment member of a separate constitution between the upper and lower auxiliary plates 22 and 20, but these embodiments also do not indicate limitation of the constitution of the present invention. Note that with the following embodiments, for the members and sites that have the same constitution as the first embodiment, a detailed description of these is omitted by respectively noting the same code numbers as those of the first embodiment for the corresponding sites in each drawing.

Figure 3:
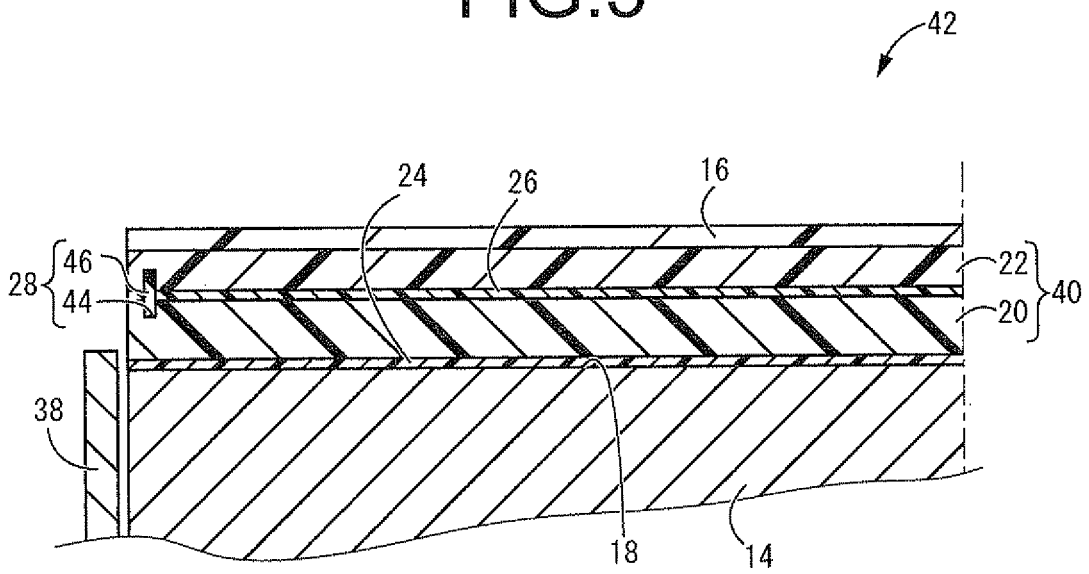
FIG. 3 is a vertical cross section view showing the key parts of a polishing device on which a polishing pad auxiliary plate according to a second embodiment of the present invention is mounted.
Figure 4:
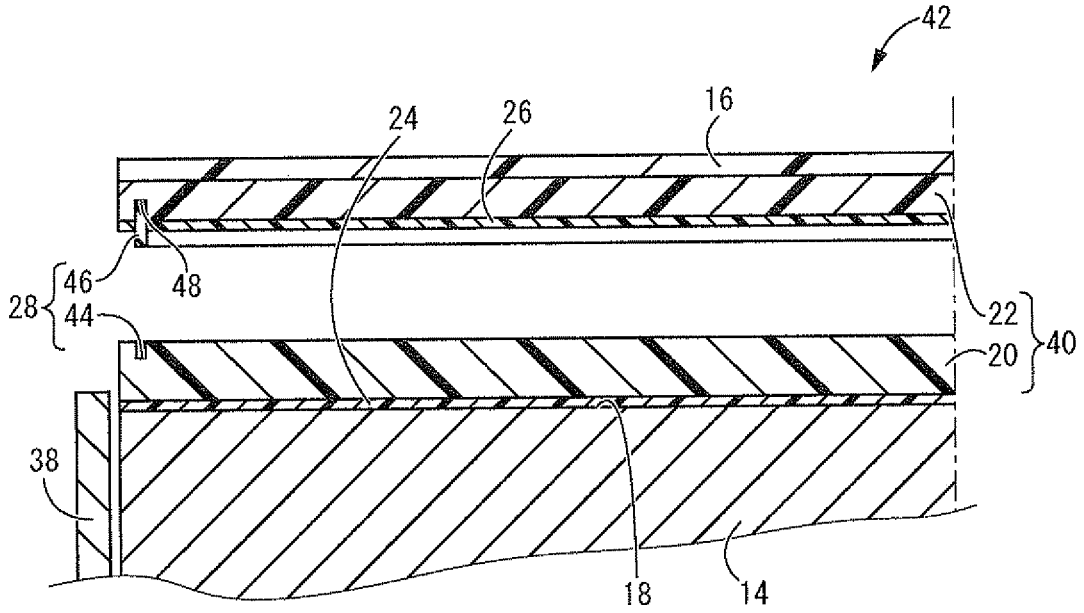
FIG. 4 is a vertical cross section explanatory view showing the state of the polishing pad removed with the polishing device shown in FIG. 3.

FIGS. 3 and 4 show a polishing device 42 equipped with a polishing pad auxiliary plate 40 as a second embodiment of the present invention.

With this polishing pad auxiliary plate 40, the engaging concave part 44 is formed by circular ring shaped grooves extending continuously in the circumference direction on the outer circumference part of the top surface of the lower auxiliary plate 20. Meanwhile, on the outer circumference part of the bottom surface of the upper auxiliary plate 22 is formed the engaging convex part 46 by circular ring shaped projections extending continuously in the circumference direction. This engaging convex part 46 can be integrally formed with the upper auxiliary plate 22, but as shown in the drawing, can also be formed as a separate item. Specifically, with this embodiment, circular ring shaped circumference groove 48 is formed extending in the circumference direction open to the bottom surface of the upper auxiliary plate 22, and on this circumference groove 48, the engaging convex part 46 is formed by a circular ring shaped block formed as a separate unit being fit into and adhered to one side of the axis direction.

The lower auxiliary plate 20 engaging concave part 44 and the upper auxiliary plate 22 engaging convex part 46 are both formed at corresponding radial direction positions around the center axis, and when the upper and lower auxiliary plates 22 and 20 are overlapped, by the engaging convex part 46 being fit into the engaging concave part 44, the upper and lower auxiliary plates 22 and 20 are mutually aligned in the radial direction. Note that with this embodiment, two sets of engaging inner circumference surfaces and engaging outer circumference surfaces are constituted by the corresponding radial direction overlapping surfaces of both side wall surfaces of the lower auxiliary plate 20 engaging concave part 44 and the inner and outer circumference surfaces of the upper auxiliary plate engaging convex part 46.

Figure 5:
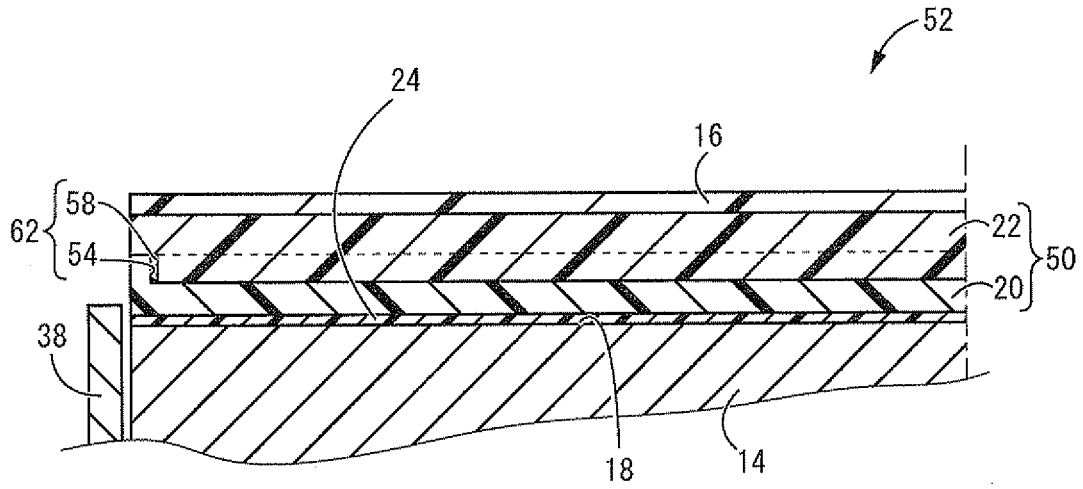
FIG. 5 is a vertical cross section view showing the key parts of a polishing device on which a polishing pad auxiliary plate according to a third embodiment of the present invention is mounted.
Figure 6:
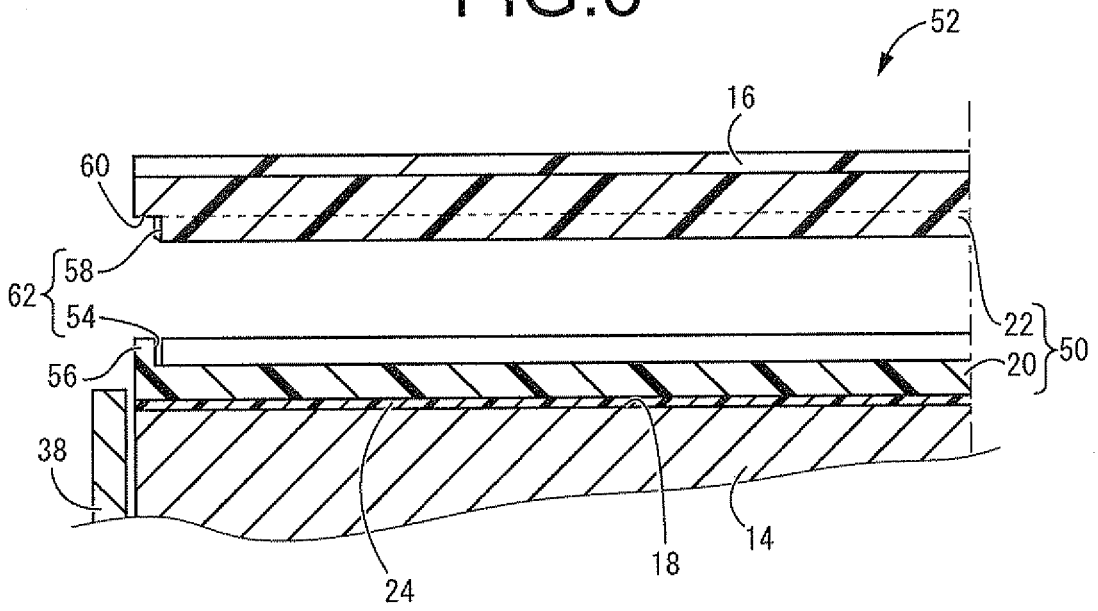
FIG. 6 is a vertical cross section explanatory view showing the state of the polishing pad removed with the polishing device shown in FIG. 5.

FIGS. 5 and 6 show a polishing device 52 equipped with a polishing pad auxiliary plate 50 shown as a third embodiment of the present invention.

With this polishing pad auxiliary plate 50, a stepped surface 54 is formed as the circular engaging inner circumference surface extending across the entire circumference around the center axis on the outer circumference part of the lower auxiliary plate 20. Then, the thickness dimension of the lower auxiliary plate 20 is made greater at the outer circumference side of this stepped surface 54. Thus, the ring shaped engaging convex part 56 extending continuously at the entire circumference of the circumference direction along the outer circumference edge of the lower auxiliary plate 20 is integrally formed with the lower auxiliary plate 20.

Meanwhile, at the outer circumference part of the upper auxiliary plate 22, a stepped surface 58 is formed as the circular engaging outer circumference surface extending across the entire circumference around the center axis. Then, the thickness dimension of the upper auxiliary plate 22 is made smaller at the outer circumference side of this stepped surface 58. Thus, a ring shaped engaging concave part 60 extending continuously at the entire circumference in the circumference direction, having a notched cross section shaped opening to the outer circumference surface of the upper auxiliary plate 22, is integrally formed with the upper auxiliary plate 22.

Furthermore, while a female screw is formed on the stepped surface 54 of the lower auxiliary plate 20, a male screw is formed on the stepped surface 58 of the upper auxiliary plate 22. Then, the male screw of the stepped surface 58 of the upper auxiliary plate 22 is screwed together with the female screw of the stepped surface 54 of the lower auxiliary plate 20, and by overlapping in the radial direction the lower auxiliary plate 20 stepped surface 54 and the upper auxiliary plate 22 stepped surface 58, the upper auxiliary plate 22 is overlapped on the top surface of the lower auxiliary plate 20. Also, in this state of being overlapped, with the screwed constitution of the stepped surfaces 58 and 54 of the upper and lower auxiliary plates 22 and 20, a second adhering member 62 is constituted for which adhering is done with the ability to remove the upper and lower auxiliary plates 22 and 20.

Note that the female and male screws of this kind of screwed constitution preferably has the screw direction set so that the screws do not loosen when considering the rotation reaction force during polishing which is applied to the rotating surface plate 14 of the polishing device 12.

Figure 7:
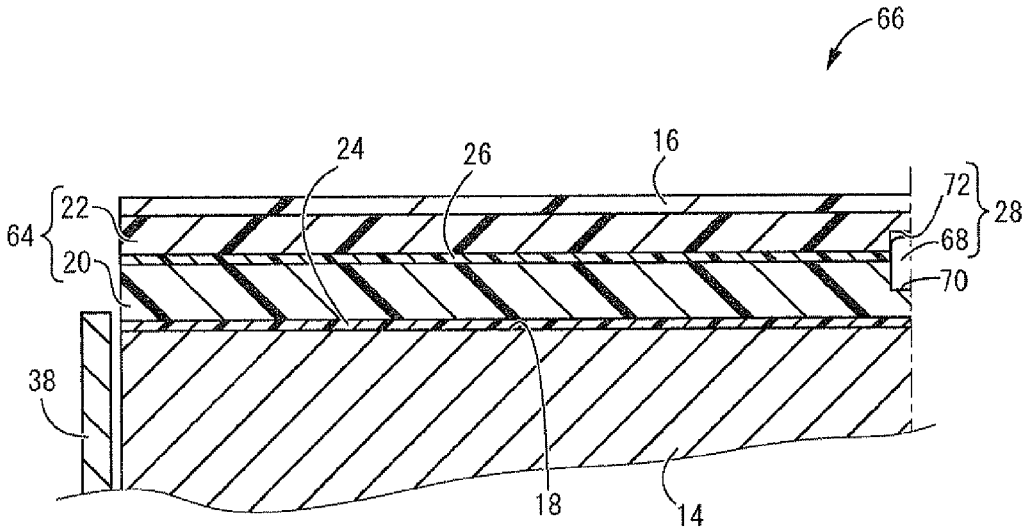
FIG. 7 is a vertical cross section view showing the key parts of a polishing device on which a polishing pad auxiliary plate according to a fourth embodiment of the present invention is mounted.
Figure 8:
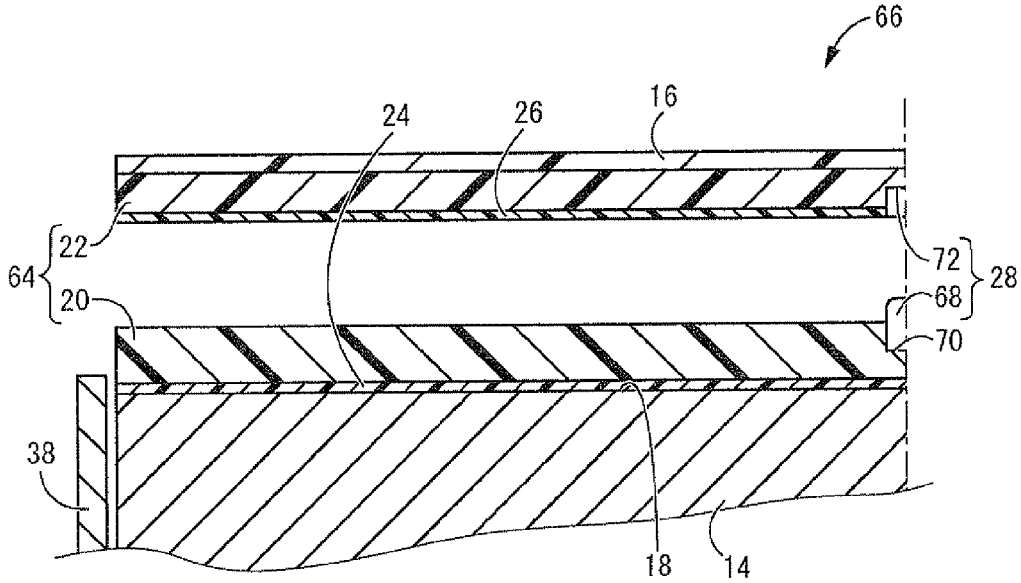
FIG. 8 is a vertical cross section explanatory view showing the state of the polishing pad removed with the polishing device shown in FIG. 7.

FIGS. 7 and 8 show a polishing device 66 equipped with a polishing pad auxiliary plate 64 as a fourth embodiment of the present invention.

With this polishing pad auxiliary plate 64, a column shaped engaging convex part 68 projecting facing upward is formed at the center part of the top surface of the lower auxiliary plate 20. This engaging convex part 68 can be integrally formed with the lower auxiliary plate 20, but as shown in the drawing, it can also be formed as a separate unit. Specifically, with this embodiment, a circular fitting recess 70 is formed on the center axis of the lower auxiliary plate 20, and by a column shaped block formed as a separate unit being fit into this fitting recess 70 at one side of the axis direction and adhered, the engaging convex part 68 is formed. Meanwhile, at the center part of the bottom surface of the upper auxiliary plate 22, a circular engaging concave part 72 with a bottom that opens to the bottom surface is formed on the center axis. Note that the engaging convex part 68 and the engaging concave part 72 can also be formed on either of the upper or lower auxiliary plates 22 or 20.

Then, by fitting the engaging convex part 68 into the engaging concave part 72 when the upper and lower auxiliary plates 22 and 20 are overlapped, the upper and lower auxiliary plates 22 and 20 are aligned with each other in the radial direction. Note that with this embodiment, the engaging outer circumference surface and the engaging inner circumference surface are constituted by the outer circumference surface of the engaging convex part 68 of the lower auxiliary plate 20 and the inner circumference surface of the engaging concave part 72 of the upper auxiliary plate 22.

Figure 9:
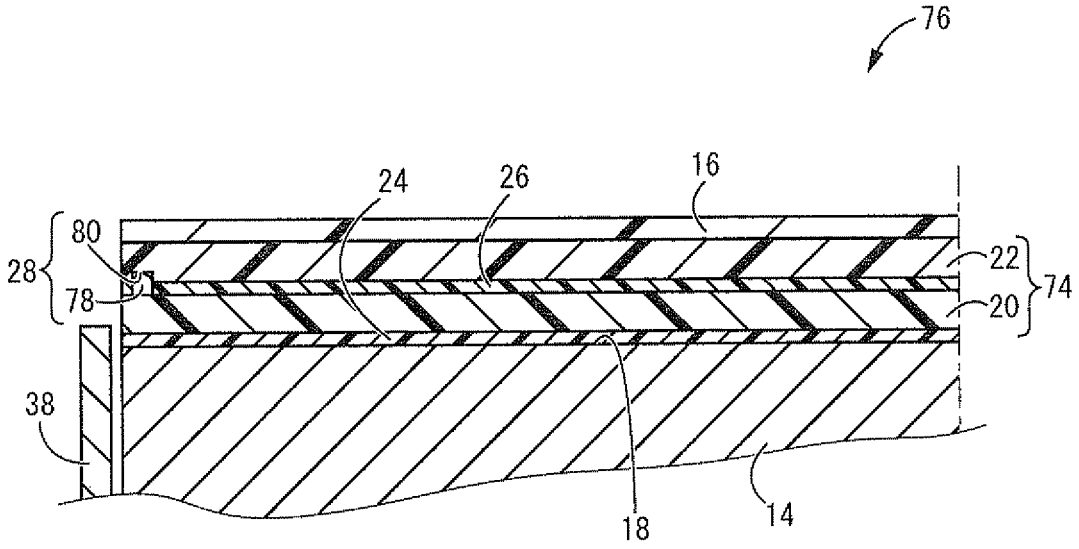
FIG. 9 is a vertical cross section view showing the key parts of a polishing device on which a polishing pad auxiliary plate according to a fifth embodiment of the present invention is mounted.

FIG. 9 shows a polishing device 76 equipped with a polishing pad auxiliary plate 74 as a fifth embodiment of the present invention.

Figure 10:
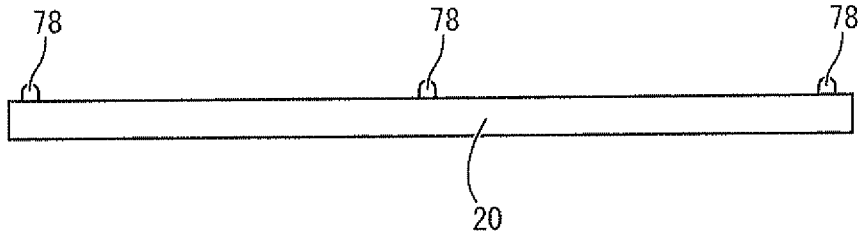
FIG. 10 is a side view of the lower auxiliary plate constituting the polishing pad auxiliary plate shown in FIG. 9.
Figure 11:
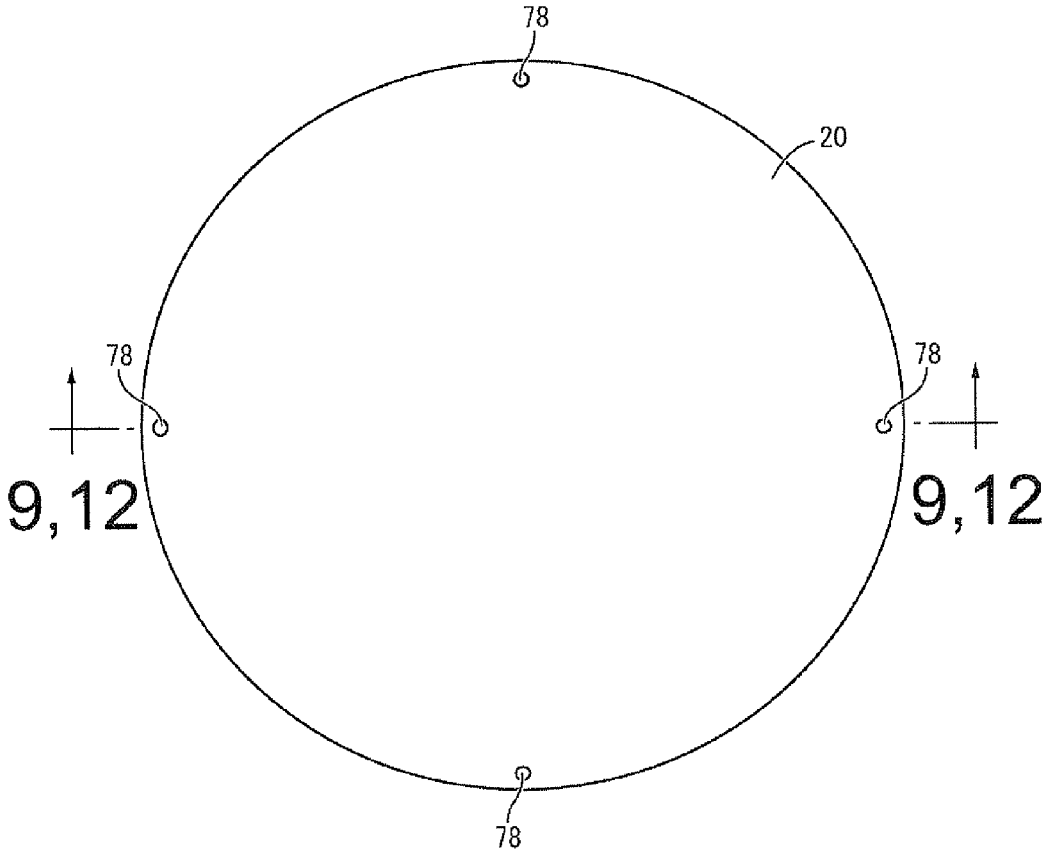
FIG. 11 is a plan view of the lower auxiliary plate shown in FIG. 10.

With this polishing pad auxiliary plate 74, a column shaped engaging convex part 78 is formed projecting facing upward at the outer circumference part of the top surface of the lower auxiliary plate 20. This engaging convex part 78 can be integrally formed with the lower auxiliary plate 20, and as with the engaging convex parts of the fourth embodiment, can also have a fitting recess formed on the lower auxiliary plate 20 and be adhered by press fitting or the like of a separate unit pin or the like. Also, as shown in FIGS. 10 and 11, a plurality of these engaging convex parts 78 are formed independently from each other with a specified distance separated in the circumference direction at the outer circumference part of the lower auxiliary plate 20. It is particularly preferable that those plurality of engaging convex parts 78 are formed positioned on the same circle on the center axis at equal intervals in the circumference direction.

Meanwhile, at the outer circumference part of the bottom surface of the upper auxiliary plate 22, a circular engaging concave part 80 with a bottom is formed opening facing downward respectively at each corresponding position in relation to formation positions of the plurality of engaging convex parts 78 on the lower auxiliary plate 20. Note that the engaging convex part 78 and the engaging concave part 80 can be formed at either of the upper or lower auxiliary plates 22 or 20.

Then, when the upper and lower auxiliary plates 22 and 20 are overlapped, by the engaging convex parts 78 respectively being fit into the engaging concave parts 80, the upper and lower auxiliary plates 22 and 20 are aligned to each other in the radial direction. Note that with this embodiment, the engaging outer circumference surface and the engaging inner circumference surface positioned at the outer circumference part of the lower auxiliary plate 20 and the upper auxiliary plate 22 are constituted by the outer circumference surface of the engaging convex part 78 of the lower auxiliary plate 20 and the inner circumference surface of the engaging concave part 80 of the upper auxiliary plate 22.

In particular, as with this embodiment, by using an alignment member consisting of a plurality of independent engaging convex parts 78 and engaging concave parts 80 in the circumference direction, the overlapped upper and lower auxiliary plates 22 and 20 can be aligned to each other not just in the radial direction but also in the circumference direction.

Figure 12:
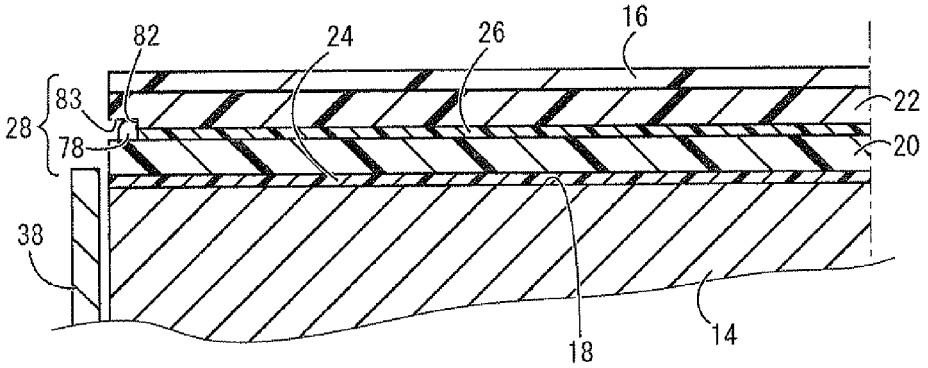
FIG. 12 is a vertical cross section view showing the key parts of a polishing device on which a polishing pad auxiliary plate according to a sixth embodiment of the present invention is mounted.

Note that instead of the plurality of independent engaging concave parts 80 formed on the upper auxiliary plate 22, it is also possible to use a circumference groove extending in a circle continuously in the circumference direction around the center axis of the upper auxiliary plate 22, or as shown in a sixth embodiment of the present invention in FIG. 12, to form a circular stepped surface 82 extending across the entire circumference around the center axis on the outer circumference part of the upper auxiliary plate 22, and by making the thickness dimension smaller at the outer circumference side of this stepped surface 82, to form a ring shaped engaging concave part 83 extending continuously at the entire circumference in the circumference direction with a notched cross section shape open at the outer circumference surface of the upper auxiliary plate 22.

In this way, with the upper auxiliary plate 22, by forming the engaging surface of the engaging convex part 78 of the lower auxiliary plate 20 continuously across the entire circumference, when the upper and lower auxiliary plates 20 and 22 are overlapped, it is possible to easily perform the mounting work without needing to align the upper and lower auxiliary plates 20 and 22 to each other in the circumference direction.

Figure 13:
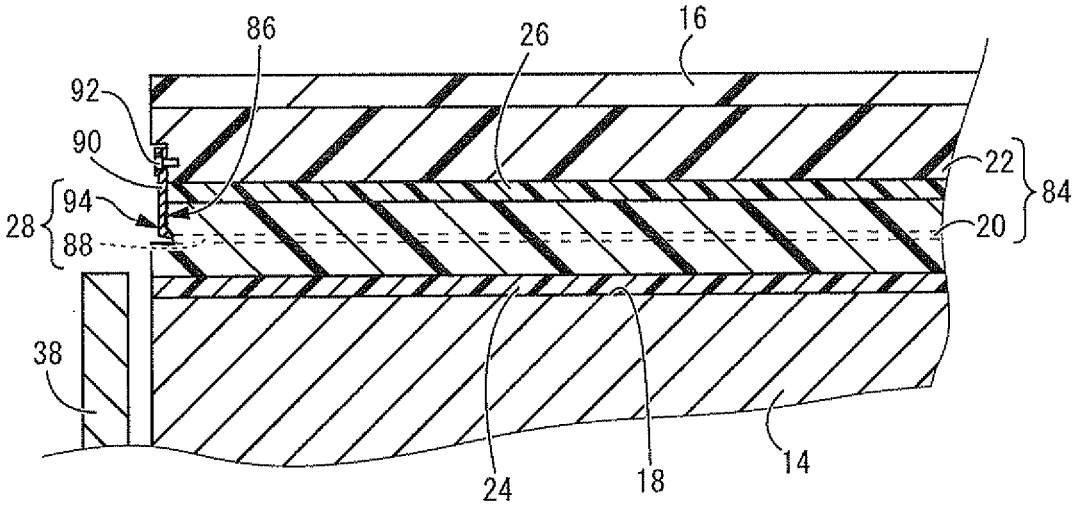
FIG. 13 is a vertical cross section view showing the key parts of a polishing device on which a polishing pad auxiliary plate according to a seventh embodiment of the present invention is mounted.

FIG. 13 shows a polishing pad auxiliary plate 84 as a seventh embodiment of the present invention.

With this polishing pad auxiliary plate 84, a small diameter part is provided respectively on the upper part of the outer circumference surface of the lower auxiliary plate 20 and the lower part of the outer circumference surface of the upper auxiliary plate 22. Then, by these upper and lower auxiliary plates 22 and 20 being overlapped, by their respective small diameter parts, a circular ring shaped holding recess 86 is formed extending across the entire circumference in the circumference direction widening at a specified width straddled across the upper and lower auxiliary plates 22 and 20.

Also, a groove shaped engaging concave part 88 is formed at the small diameter part lower edge of the lower auxiliary plate 20. This engaging concave part 88 is opened to the outer circumference surface of the lower auxiliary plate 20 at the bottom surface of the holding recess 86. Here, the bottom surface of the holding recess 86 indicates, of the surfaces constituting the holding recess 86, the ring shaped surface that widens in the vertical direction of FIG. 13 straddling the upper and lower auxiliary plates 22 and 20. Meanwhile, at the small diameter part of the upper auxiliary plate 22 constituting the holding recess 86, the plate shaped engaging convex part 90 consisting of elastic material is fixed and attached by a fixing pin 92 at the base end part. This engaging convex part 90 is held and arranged in the holding recess 86 formed at the outer circumference surface of the upper and lower auxiliary plates 22 and 20, and extends out above the outer circumference surface of the lower auxiliary plate 20 from the upper auxiliary plate 22. Then, an engaging hook part 94 of the tip part of the engaging convex part 90 is latched to the engaging concave part 88 formed on the small diameter part of the lower auxiliary plate 20, and is held in a latched state based on the elasticity of the engaging convex part 90.

Furthermore, a plurality of this kind of engaging convex part 90 are provided separated by a specified distance in the circumference direction on the outer circumference surface of the upper and lower auxiliary plates 22 and 20. Then, each engaging convex part 90 attached to the outer circumference surface of the upper auxiliary plate 22 constitutes an alignment member that mutually aligns the upper and lower auxiliary plates 22 and 20 on the center axes by elastically pressing on the outer circumference surface of the lower auxiliary plate 20. Also, by latching the engaging hook part 94 of the engaging convex part 90 to the engaging concave part 88, an adhering means is also constituted which applies adhesive force while holding the upper and lower auxiliary plates 22 and 20 in an overlapped state.

Figure 14:
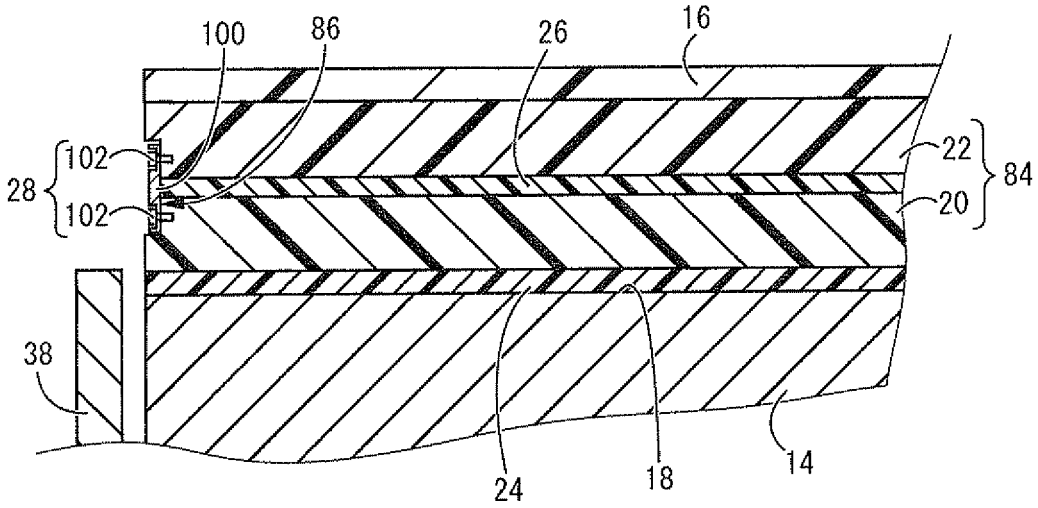
FIG. 14 is a vertical cross section view showing the key parts of a polishing device on which a polishing pad auxiliary plate according to an eighth embodiment of the present invention is mounted.

Note that instead of the engaging convex part 90 equipped with an engaging hook part 94 for engaging with the engaging concave part 88 as described above, as with the eighth embodiment of the present invention shown in FIG. 14, for example, it is also possible to use a linking plate 100 overlapping the bottom surface of the holding recess 86 extending straddled across the upper and lower auxiliary plates 22 and 20, and adhere both end parts of this linking plate 100 to one outer circumference surface of each of the upper and lower auxiliary plates 22 and 20 using linking pins 102 and 102. Note that by making it possible for at least one of the linking pins 102, 102 to be detachable in relation to the lower auxiliary plate 20 or the upper auxiliary plate 22, it is possible to release the linking by the linking plates 100 of the upper and lower auxiliary plates 22 and 20, so that attaching and detaching of the upper auxiliary plate 22 to which the polishing pad 16 is adhered in relation to the lower auxiliary plate 20 is possible.

Also, the first adhering member 24 and second adhering member 26 consisting of double sided tape or the like shown in the first through eighth embodiments are preferably kept at the adhering surface of a special member side when removing the upper and lower auxiliary plates 22 and 20 or the rotating surface plate 14. This is because by doing this, handling of the upper and lower auxiliary plates 22 and 20 and the first and second adhering members 24 and 26 in a removed state is easier. Note that which of the adhesion surfaces the first and second adhering members 24 and 26 remain on can be set by things such as making the adhesive force of both surfaces of the first adhering member and second adhering member 24 and 26 themselves different from each other, or also by making the surface roughness or the material or the like of the adhered upper and lower auxiliary plates 22 and 20 or the rotating surface plate 14 different from each other.

Figure 15:
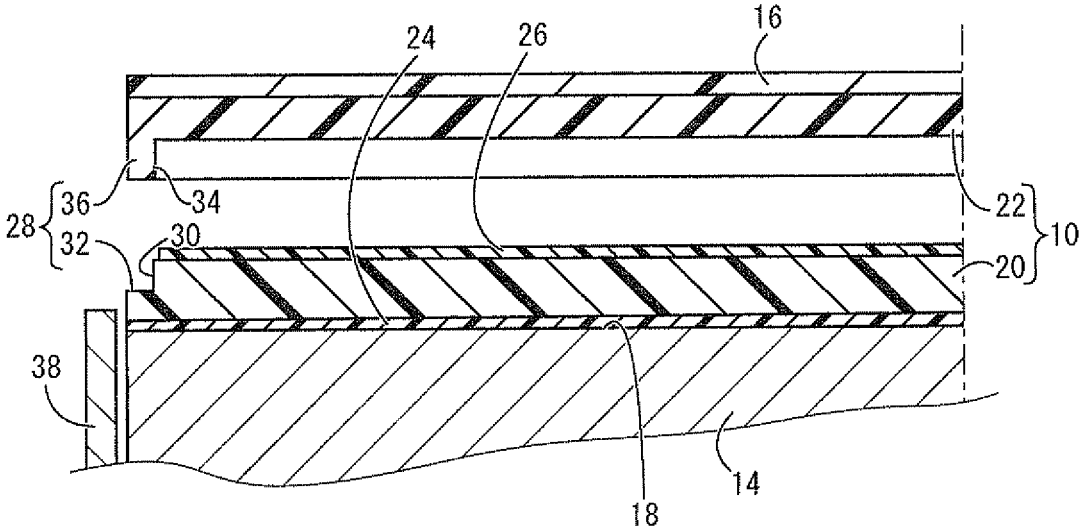
FIG. 15 is a vertical cross section explanatory view showing the state of the polishing pad auxiliary plate removed as a ninth embodiment of the present invention.

In particular, the first adhering member 24 is preferably kept on the adhesion surface of the lower auxiliary plate 20 side when removing the lower auxiliary plate 20, making it easy to perform a maintenance of the top surface 18 of the rotating surface plate 14. Meanwhile, the second adhering member 26, as shown in FIG. 2 with the first embodiment, can be kept on the adhesion surface of the upper auxiliary plate 22 side when removing the upper auxiliary plate 22, or for example, as with the ninth embodiment of the present invention shown in FIG. 15, can be left on the top surface of the lower auxiliary plate 20. Note that by keeping the second adhering member 26 on the adhesion surface of the upper auxiliary plate 22 side, it is possible to do attachment using the second adhering member 26 held on the upper auxiliary plate 22 when mounting the removed upper auxiliary plate 22 on the rotating surface plate of the re-processing device such as for grooving or the like of the polishing pad 16. Meanwhile, by keeping the second adhering member 26 on the adhesion surface of the lower auxiliary plate 20 side, when mounting a separate upper auxiliary plate 22 for which a separate polishing pad 16 is mounted on the lower auxiliary plate 20, it is possible to do attachment using the second adhering member 26 kept on the lower auxiliary plate 20.

Figure 16:
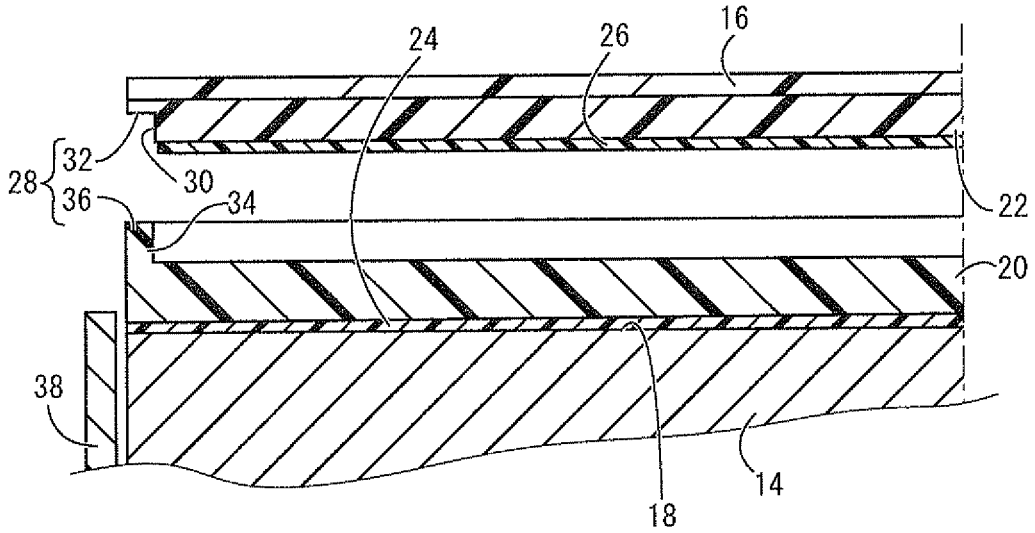
FIG. 16 is a vertical cross section explanatory view showing the state of the polishing pad auxiliary plate removed as a tenth embodiment of the present invention.

Also, the engaging concave parts 32, 44, 60, 72, 80, (83), and 88 and the engaging convex parts 36, 46, 56, 70, 78, and 90 shown in the first through seventh embodiments can also be provided on the mutually opposite sides at the lower auxiliary plate 20 side and the upper auxiliary plate 22 side. As shown in FIG. 16, with the tenth embodiment of the present invention, for example, while forming the stepped surface 30 and the engaging concave part 32 constituting the engaging outer circumference surface for the polishing pad auxiliary plate 10 shown in FIGS. 1 and 2 as a first embodiment on the upper auxiliary plate 22, it is possible to form the stepped surface 34 and the engaging convex part 36 constituting the engaging inner circumference surface on the lower auxiliary plate 20.

Figure 17:
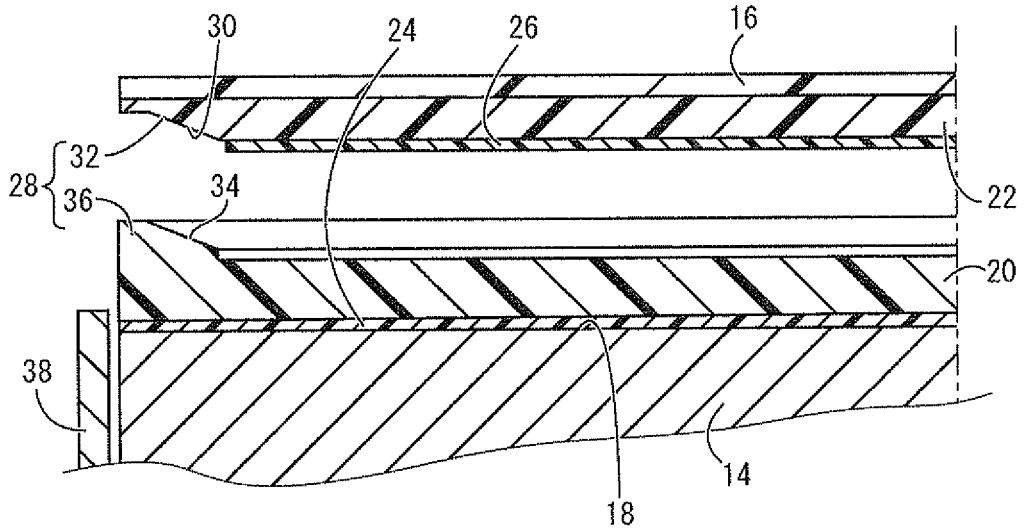
FIG. 17 is a vertical cross section explanatory view showing the state of the polishing pad auxiliary plate removed as an eleventh embodiment of the present invention.

Furthermore, it is also possible to give an inclined angle to the outer circumference surface of the engaging convex part and the inner circumference surface of the engaging concave part which align the upper and lower auxiliary plates 22 and 20 overlapped with each other with the engaging concave parts 32, 44, 60, 72, 80, and (83) and the engaging convex parts 36, 46, 56, 70, and 78 shown in the first through sixth embodiments. For example, as shown in FIG. 17, the eleventh embodiment of the present invention, while giving a taper in an inclined direction for which the engaging convex part 36 gradually becomes a taper in the projection direction to the stepped surface 34 as the engaging inner circumference surface of the engaging convex part 36 formed projecting at the outer circumference part of the lower auxiliary plate 20, it is possible to give an inclined direction and incline angle taper corresponding to the stepped surface 34 to the stepped surface 30 as the engaging outer circumference surface of the engaging concave part 32 formed at the outer circumference part of the upper auxiliary plate 22. This makes it possible to more easily perform the work of fitting the engaging convex part 36 into the engaging concave part 32 and overlapping the upper and lower auxiliary plates 22 and 20 by using the taper given to both the stepped surfaces 34 and 30 as a guide surface.

Figure 18:
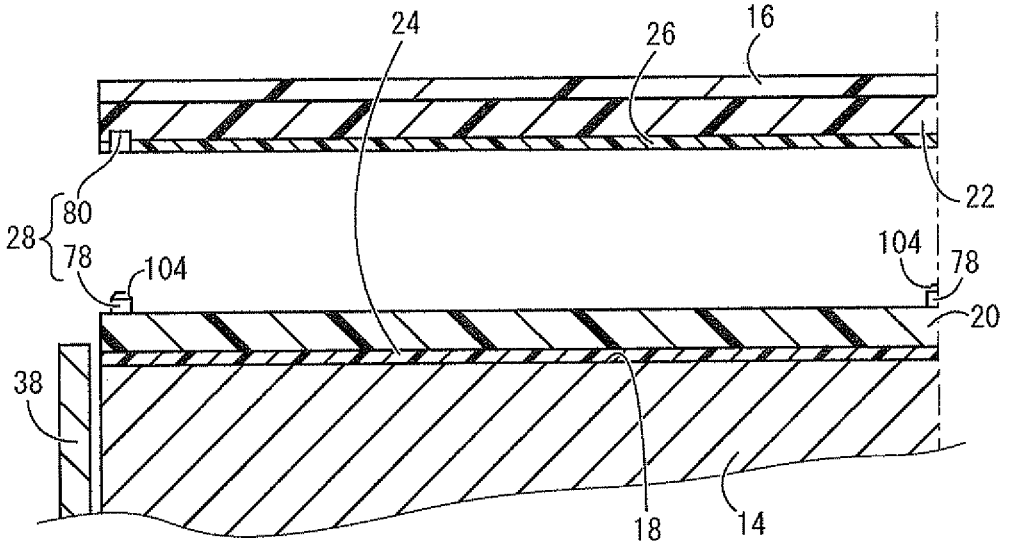
FIG. 18 is a vertical cross section explanatory view showing the state of the polishing pad auxiliary plate removed as a twelfth embodiment of the present invention.
Figure 19:
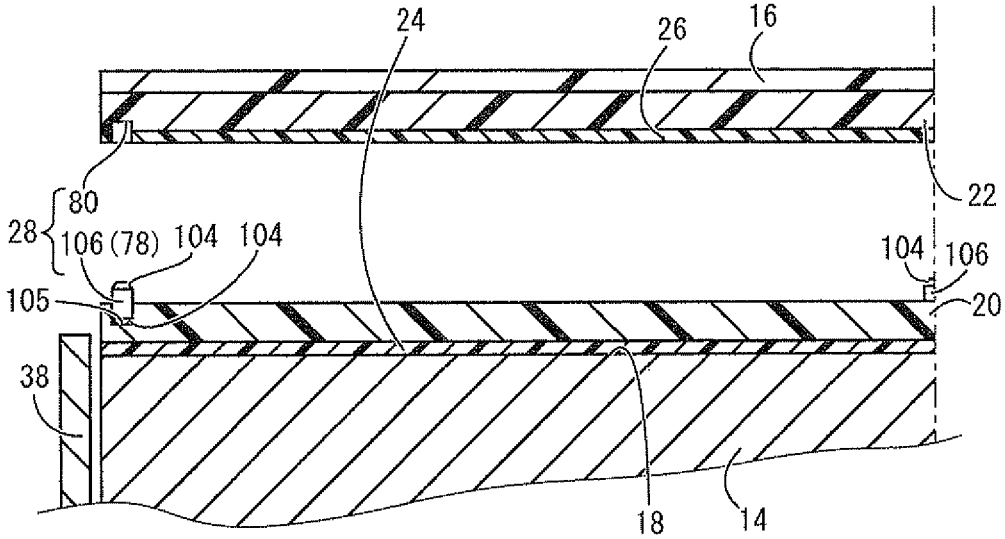
FIG. 19 is a vertical cross section explanatory view showing the state of the polishing pad auxiliary plate removed as a thirteenth embodiment of the present invention.

Incidentally, as shown by the twelfth embodiment of the present invention noted in FIG. 18 and the thirteenth embodiment of the present invention noted in FIG. 19, even when using the plurality of projection shaped engaging convex parts 78 formed independently in the circumference direction of the lower auxiliary plate 20, and the plurality of hole-shaped engaging concave parts 80 formed at each corresponding position of the upper auxiliary plates 22, it is possible to give an incline angle to the outer circumference surface of the projecting tip part of the engaging convex part 78, and to form a taper shaped taper part 104. Note that with FIG. 19, the engaging convex part 78 is adhered by press fitting or the like by a latch pin 106 formed as a separate unit in relation to the fitting hole 105 formed on the lower auxiliary plate 20, and a similar taper part 104 as the top edge is also given to the bottom edge of this latch pin 106. By so doing, the directionality of the latch pin 106 is eliminated so handling becomes easier, and also, the work of press fitting to the fitting hole 105 becomes easier.

Figure 20:
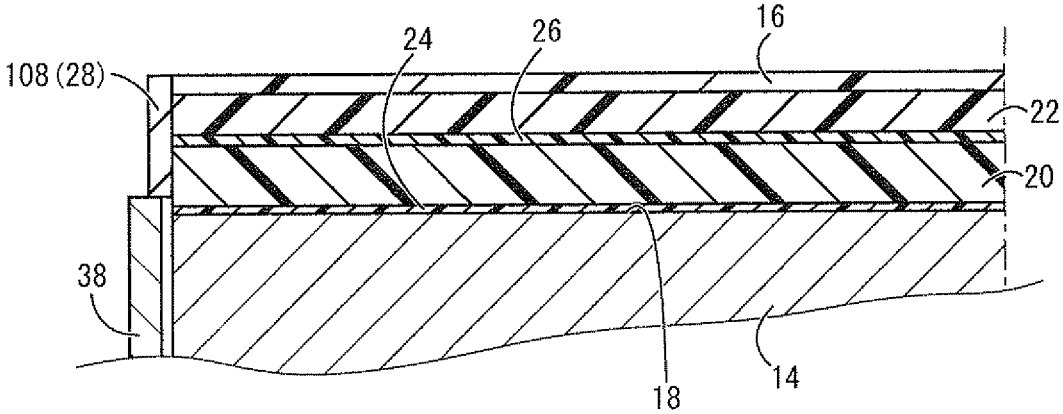
FIG. 20 is a vertical cross section explanatory view showing the state of the polishing pad auxiliary plate aligned as a fourteenth embodiment of the present invention.

Also, with the fourteenth embodiment of the present invention shown in FIG. 20, as one type of alignment member for matching the center axes in a state with the upper and lower auxiliary plates 22 and 20 overlapped, an aligning sleeve 108 which straddles across those upper and lower auxiliary plates 22 and 20 and is extrapolated is shown. This aligning sleeve 108 has the same or a slightly larger inner diameter dimension than the outer diameter dimension of the upper and lower auxiliary plates 22 and 20 which are circular disk shapes of approximately the same outer diameter dimensions to each other, and is formed by a metal material or synthetic resin material. Using this kind of aligning sleeve 108 when overlapping the upper and lower auxiliary plates 22 and 20, by overlapping the upper and lower auxiliary plates 22 and 20 within the aligning sleeve 108, it is possible to overlap the upper and lower auxiliary plates 22 and 20 in the axis direction while matching the center axes, and to mutually adhere them with the second adhering member 26. Because of that, it is possible to remove the aligning sleeve 108 after overlapping and mutually adhering the upper and lower auxiliary plates 22 and 20, making it possible to mutually adhere the upper and lower auxiliary plates 22 and 20 in a state without having an alignment member projecting above the outer circumference surface and in a state accurately aligned.

Figure 21:
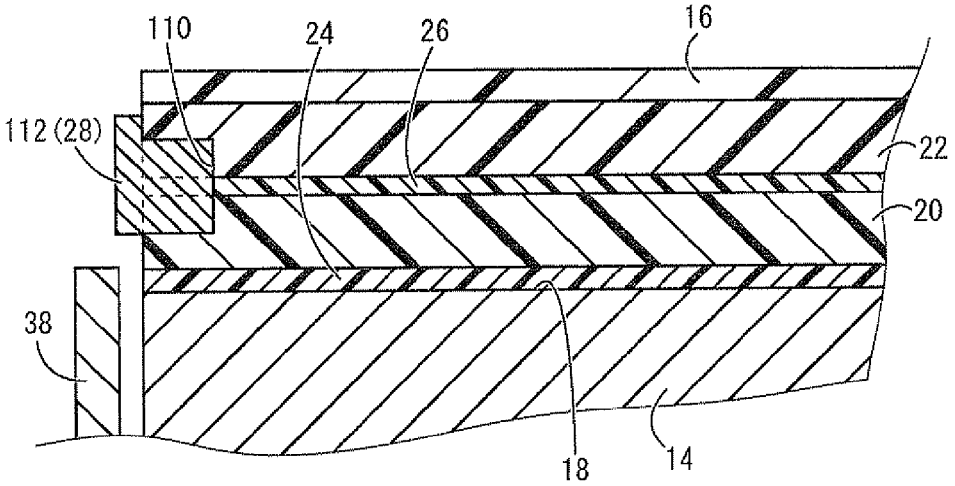
FIG. 21 is a vertical cross section explanatory view showing the state of the polishing pad auxiliary plate aligned as a fifteenth embodiment of the present invention.

Furthermore, with the fifteenth embodiment of the present invention shown in FIG. 21, a slit shaped engaging groove 110 extending straddling in the overlapping direction in a state with the upper and lower auxiliary plates 22 and 20 overlapped is formed. This engaging groove 110 has a specified depth in the radial direction inward direction opened at the outer circumference surface of the upper and lower auxiliary plates 22 and 20, and a plurality of these are provided mutually independently in the circumference direction of the upper and lower auxiliary plates 22 and 20. Then, by fitting a plate shaped engaging plate 112 from the opening part of the outer circumference surface in this engaging groove 110, the upper and lower auxiliary plates 22 and 20 are aligned to each other by this engaging plate 112, and they are also in a mutually linked state. Note that this engaging plate 112 is formed as a separate unit from the upper and lower auxiliary plates 22 and 20, but for example it is also possible to integrally form this having a shape projecting toward the other of one of either the upper or lower auxiliary plates 22 or 20. In this case, the engaging groove 110 is formed only on the concerned other of the auxiliary plates.

Figure 22:
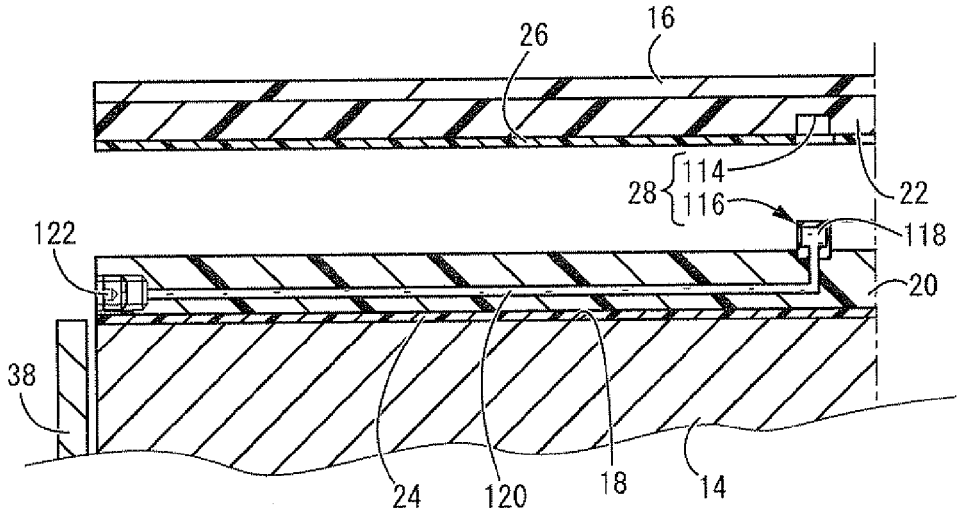
FIG. 22 is a vertical cross section explanatory view showing the state of the polishing pad auxiliary plate removed as a sixteenth embodiment of the present invention.

Also, with the sixteenth embodiment of the present invention shown in FIG. 22, an engaging concave part 114 is formed as the engaging concave part that opens at the bottom surface of the upper auxiliary plate 22. In particular with this embodiment, this engaging concave part 114 is formed as a ring shaped groove extending continuously in the circumference direction around the center axis of the upper auxiliary plate 22. Meanwhile, an engaging convex part 116 is formed on the lower auxiliary plate 20 as the engaging convex part projecting upward at the top surface which is overlapped on the upper auxiliary plate 22. Note that with this embodiment, this engaging convex part 116 is formed as a ring shaped convex part corresponding to the engaging concave part 114. Then, in a state with the upper and lower auxiliary plates 22 and 20 overlapped, the engaging convex part 116 enters into the engaging concave part 114 for alignment.

Also, the engaging convex part 116 has a hollow constitution, and a sealed fluid pool 118 is formed in an external space on the interior of the engaging convex part 116. Furthermore, the wall part of the engaging convex part 116 which delineates this fluid pool 118 is made so that at least the inner circumference wall and the outer circumference wall are able to bulge and deform facing the radial direction. In specific terms, for example by the engaging convex part 116 being formed by a rubber elastic body or the like, it is possible to realize an inner circumference wall that can bulge in the radial direction inward and an outer circumference wall that can bulge in the radial direction outward.

Furthermore, a fluid passage 120 that opens at the outer circumference surface extending out in the radial direction outward is formed communicating with the fluid pool 118 on the lower auxiliary plate 20, and also, a pressure screw 122 is screwed in at the outer circumference edge opening part of this fluid passage 120. Also, an incompressible fluid such as oil or the like is filled in a sealed area consisting of the fluid passage 120 sealed by the pressure screw 122 and the fluid pool 118.

By screwing in the pressure screw 122, the internal pressure of the fluid pool 118 is raised through the fluid passage 120, and it is possible to have the fluid pool 118 inner circumference wall and outer circumference wall bulge outward. As a result, the engaging convex part 116 expands and is pressed on the inner surface of the engaging concave part 114, and it is possible to align the upper and lower auxiliary plates 22 and 20 to each other by the mutual friction force or the like, and also to apply adhesive force.

Note that when removing the upper auxiliary plate 22 from the lower auxiliary plate 20, by doing the rotation operation in the direction that loosens the pressure screw 122, and moving to the outer circumference side of the lower auxiliary plate 20, it is possible to reduce the pressure of the fluid pool 118 and to cancel the pressing force of the engaging convex part 116 on the engaging concave part 114.

In addition, though not listed one by one, with the present invention, it is possible to implement additional changes, revisions, modifications or the like of various types based on the knowledge of a person skilled in the art, and for example it is possible to prevent infiltration of foreign substances to the overlapping surfaces or the like of the upper and lower auxiliary plates by mounting an O-ring or sealing material at the engagement portions of the engaging convex part and the engaging concave part.

Also, in addition to the two layer structure auxiliary plates 20 and 22 described above, it is also possible to add another auxiliary plate adhered in a laminated state using the adhering means. By using this kind of third layer auxiliary plate, it is possible to realize an elastic support state, or a state such as the middle layer being disposable or the like.

What is claimed is:

1. A polishing pad auxiliary plate adapted to be mounted on a rotating surface plate of a polishing device for detachably attaching a polishing pad on the rotating surface plate, the polishing pad auxiliary plate comprising:

a lower auxiliary plate adapted for overlapping a top surface of the rotating surface plate;

a first adhering member for adhering the lower auxiliary plate to the rotating surface plate;

an upper auxiliary plate equipped with a pad support surface on which the polishing pad is overlapped and adhered, and adapted for overlapping a top surface of the lower auxiliary plate;

a second adhering member for adhering the upper auxiliary plate to the lower auxiliary plate; and an alignment member for mutually aligning the lower auxiliary plate and the upper auxiliary plate and matching center axes thereof, wherein by removing the upper auxiliary plate from the lower auxiliary plate adhered to the rotating surface plate by means of the first adhering member, the polishing pad is removable from the rotating surface plate in a state still adhered to the pad support surface of the upper auxiliary plate, and the removed upper auxiliary plate is re-adhereable and attachable in an aligned state to the lower auxiliary plate by means of the alignment member, wherein:

the alignment member is provided at a position further to an inner circumference side than an outer circumference surface of the lower auxiliary plate and the upper auxiliary plate, the alignment member comprises at least one engaging convex part provided on one of the lower auxiliary plate and the upper auxiliary plate and projecting facing an other, and at least one engaging concave part provided on the other of the lower auxiliary plate and the upper auxiliary plate and engaging with the engaging convex part, the engaging convex part and the engaging concave part are formed with engagement portions positioned at an outer circumference part of the lower auxiliary plate and the upper auxiliary plate, and the engagement portions of the engaging convex part and the engaging concave part are constituted by a ring shaped engaging outer circumference surface and engaging inner circumference surface which are fit to each other extending continuously in a circumference direction of the lower auxiliary plate and the upper auxiliary plate.

2. The polishing pad auxiliary plate according to claim 1, wherein an adhesive force of the lower auxiliary plate and the upper auxiliary plate by the second adhering member is smaller than an adhesive force of the rotating surface plate and the lower auxiliary plate by the first adhering member.

3. The polishing pad auxiliary plate according to claim 1, wherein the engaging convex part and the engaging concave part are provided on a center axis of the lower auxiliary plate and the upper auxiliary plate.

4. A polishing pad auxiliary plate adapted to be mounted on a rotating surface plate of a polishing device for detachably attaching a polishing pad on the rotating surface plate, the polishing pad auxiliary plate comprising:

a lower auxiliary plate adapted for overlapping a top surface of the rotating surface plate;

a first adhering member for adhering the lower auxiliary plate to the rotating surface plate;

an upper auxiliary plate equipped with a pad support surface on which the polishing pad is overlapped and adhered, and adapted for overlapping a top surface of the lower auxiliary plate;

a second adhering member for adhering the upper auxiliary plate to the lower auxiliary plate; and an alignment member for mutually aligning the lower auxiliary plate and the upper auxiliary plate and matching center axes thereof, wherein:

by removing the upper auxiliary plate from the lower auxiliary plate adhered to the rotating surface plate by means of the first adhering member, the polishing pad is removable from the rotating surface plate in a state still adhered to the pad support surface of the upper auxiliary plate, and the removed upper auxiliary plate is re-adhereable and attachable in an aligned state to the lower auxiliary plate by means of the alignment member, the alignment member is provided at a position further to an inner circumference side than an outer circumference surface of the lower auxiliary plate and the upper auxiliary plate, the alignment member comprises at least one engaging convex part provided on one of the lower auxiliary plate and the upper auxiliary plate and projecting facing an other, and at least one engaging concave part provided on the other of the lower auxiliary plate and the upper auxiliary plate and engaging with the engaging convex part, the engaging convex part and the engaging concave part are provided on a center axis of the lower auxiliary plate and the upper auxiliary plate, and thread grooves that screw together are formed at an outer circumference surface of the engaging convex part and an inner circumference surface of the engaging concave part, and the second adhering member is constituted by the engaging concave part and the engaging convex part that constitute the alignment member being screwed together.

5. The polishing pad auxiliary plate according to claim 3, wherein the engaging convex part provided at one of the lower auxiliary plate and the upper auxiliary plate is formed with the same material as the one of the lower auxiliary plate and the upper auxiliary plate.

6. A polishing device, wherein the device is equipped with a polishing pad auxiliary plate that is adapted to be mounted on a rotating surface plate of the polishing device for detachably attaching a polishing pad on the rotating surface plate, the polishing pad auxiliary plate including:

a lower auxiliary plate adapted for overlapping a top surface of the rotating surface plate;

a first adhering member for adhering the lower auxiliary plate to the rotating surface plate;

an upper auxiliary plate equipped with a pad support surface on which the polishing pad is overlapped and adhered, and adapted for overlapping a top surface of the lower auxiliary plate;

a second adhering member for adhering the upper auxiliary plate to the lower auxiliary plate; and an alignment member for mutually aligning the lower auxiliary plate and the upper auxiliary plate and matching center axes thereof, wherein by removing the upper auxiliary plate from the lower auxiliary plate adhered to the rotating surface plate by means of the first adhering member, the polishing pad is removable from the rotating surface plate in a state still adhered to the pad support surface of the upper auxiliary plate, and the removed upper auxiliary plate is re-adhereable and attachable in an aligned state to the lower auxiliary plate by means of the alignment member, wherein:

the alignment member is provided at a position further to an inner circumference side than an outer circumference surface of the lower auxiliary plate and the upper auxiliary plate, the alignment member comprises at least one engaging convex part provided on one of the lower auxiliary plate and the upper auxiliary plate and projecting facing an other, and at least one engaging concave part provided on the other of the lower auxiliary plate and the upper auxiliary plate and engaging with the engaging convex part, the engaging convex part and the engaging concave part are formed with engagement portions positioned at an outer circumference part of the lower auxiliary plate and the upper auxiliary plate, the engagement portions of the engaging convex part and the engaging concave part are constituted by a ring shaped engaging outer circumference surface and engaging inner circumference surface which are fit to each other extending continuously in a circumference direction of the lower auxiliary plate and the upper auxiliary plate, and the polishing pad auxiliary plate is mounted on the top surface of the rotating surface plate, and a protective member is provided arranged across a gap at an outer circumference side of the rotating surface plate, while the alignment member is provided positioned further to an inner circumference side than outer circumference end surfaces of the rotating surface plate and the polishing pad auxiliary plate.

* * * * *